US012532945B2

(12) United States Patent
Acquaviva et al.

(10) Patent No.: US 12,532,945 B2
(45) Date of Patent: Jan. 27, 2026

(54) SOLE STRUCTURES, AND ARTICLES OF FOOTWEAR FORMED THEREFROM

(71) Applicant: NIKE, Inc., Beaverton, OR (US)

(72) Inventors: Jaclyn Acquaviva, Portland, OR (US); Neil Crumbleholme, Lake Oswego, OR (US); Isaac Farr, Beaverton, OR (US); Sean T. O'Brien, Hillsboro, OR (US); Jason Riddell, Beaverton, OR (US); Michele Tosello, Beaverton, OR (US); Zachary C. Wright, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/588,728

(22) Filed: Feb. 27, 2024

(65) Prior Publication Data

US 2024/0285035 A1 Aug. 29, 2024

Related U.S. Application Data

(60) Provisional application No. 63/487,531, filed on Feb. 28, 2023.

(51) Int. Cl.
*A43C 15/16* (2006.01)
*A43B 13/22* (2006.01)

(52) U.S. Cl.
CPC ..... *A43C 15/165* (2013.01); *A43B 13/223* (2013.01); *A43C 15/161* (2013.01)

(58) Field of Classification Search
CPC ... A43C 15/161; A43C 15/165; A43C 15/167; A43B 13/24
See application file for complete search history.

(56) References Cited

U.S. PATENT DOCUMENTS 3,738,026 A * 6/1973 Granger ..... A43B 5/001 36/134
4,445,289 A * 5/1984 Beneteau ..... A43D 999/00 36/134
4,561,197 A * 12/1985 Misevich ..... A43C 15/161 36/134
4,644,672 A * 2/1987 Dassler ..... A43C 15/161 36/62
4,648,187 A * 3/1987 Dassler ..... A43C 15/161 36/134
4,712,318 A * 12/1987 Greiner ..... A43C 15/161 36/134

(Continued)

FOREIGN PATENT DOCUMENTS

GB 527779 A * 10/1940
GB 552849 A * 4/1943
WO WO-9211781 A1 * 7/1992 ..... A43B 13/26

OTHER PUBLICATIONS

European Patent Office (ISA), International Search Report and Written Opinion for PCT App. No. PCT/US2024/017610, mailed May 7, 2024.

*Primary Examiner* — Megan E Lynch
(74) *Attorney, Agent, or Firm* — Honigman LLP; Matthew H. Szalach; Jonathan P. O'Brien

(57) ABSTRACT

A variety of sole structures for footwear, including plates with traction elements, are provided. Articles of footwear which include the sole structures are also provided. Methods of making the sole structures, and articles of footwear which include the sole structures, are also provided.

20 Claims, 18 Drawing Sheets

(56) References Cited

U.S. PATENT DOCUMENTS

| | | | | | |
|---|---|---|---|---|---|
| 4,791,692 | A * | 12/1988 | Collins | A43C 15/161 | 12/142 P |
| 5,243,775 | A * | 9/1993 | Swain | A43B 13/26 | 36/134 |
| 5,321,901 | A * | 6/1994 | Kelly | A43B 5/001 | 36/134 |
| 11,497,272 | B2 | 11/2022 | Bidal et al. | | |
| 2003/0093926 | A1* | 5/2003 | Auger | A43C 15/162 | 36/134 |
| 2011/0088287 | A1* | 4/2011 | Auger | A43B 13/125 | 36/114 |
| 2014/0215862 | A1* | 8/2014 | Curl | A43B 23/17 | 36/59 R |
| 2018/0117867 | A1* | 5/2018 | Yang | A43B 13/26 | |
| 2022/0125164 | A1* | 4/2022 | Cobb | A43C 15/161 | |
| 2022/0408875 | A1* | 12/2022 | Farr | C08L 23/12 | |
| 2024/0065384 | A1* | 2/2024 | Yang | A43C 13/04 | |

* cited by examiner

SOLE STRUCTURES, AND ARTICLES OF FOOTWEAR FORMED THEREFROM

CROSS REFERENCE TO RELATED APPLICATIONS

This application claims priority under 35 U.S.C. § 119(e) to U.S. Provisional Application No. 63/487,531, filed on Feb. 28, 2023. The disclosure of this prior application is considered part of the disclosure of this application and is hereby incorporated by reference in its entirety.

TECHNICAL FIELD

The present disclosure generally relates to sole structures for articles of footwear, the sole structures including a plate and one or more traction element. The present disclosure also generally relates to footwear including these sole structures, and methods of manufacturing the sole structures and articles of footwear. The plate portion of the sole structure includes a low surface energy resin and/or a hydrophobic resin, such as a thermoplastic polyolefin-based resin. The one or more traction element includes a higher surface energy resin and/or a less hydrophobic resin, such as a thermoplastic polyurethane-based resin.

BACKGROUND

The design and manufacture of footwear involves a variety of factors including the comfort, feel, performance and durability of the footwear, as well as aesthetic and manufacturing considerations. While design and fashion may be rapidly changing, the demand for increasing performance in the footwear market is unchanging. In addition, the market has shifted to demand lower-cost and recyclable materials still capable of meeting increasing performance demands. However, the materials used to produce the footwear still need to provide durable and high-performance products. To balance these demands, designers of footwear employ a variety of materials and designs for the various components.

BRIEF DESCRIPTION OF THE DRAWINGS

Further aspects of the present disclosure will be readily appreciated upon review of the detailed description, described below, when taken in conjunction with the accompanying drawings.

DETAILED DESCRIPTION

Figure 1A:
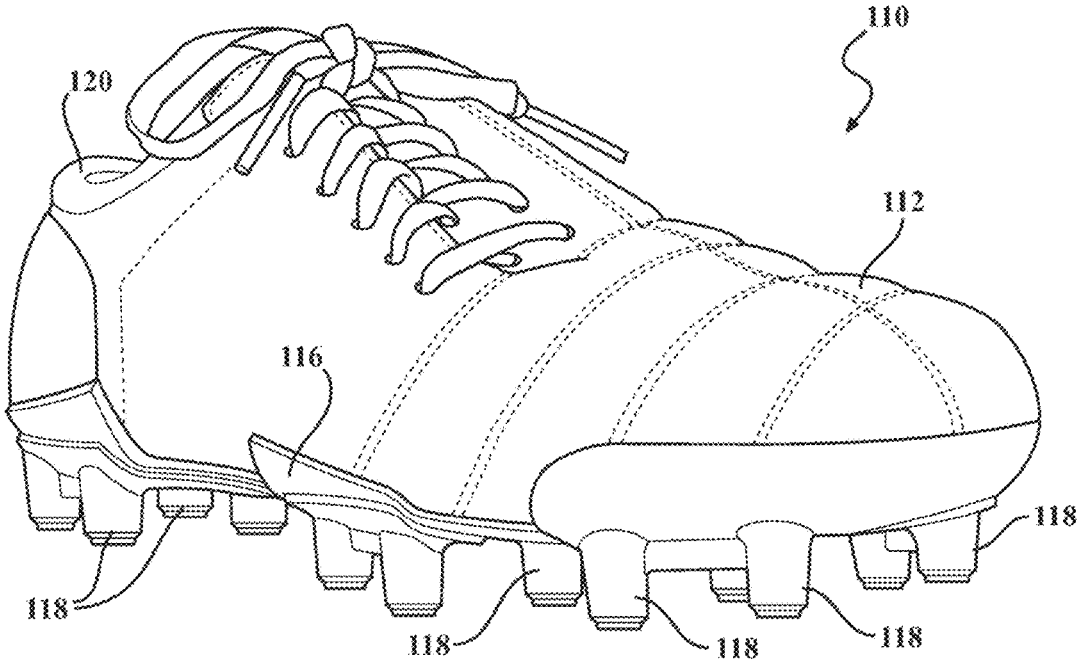
FIG. 1A is an exemplary article of athletic footwear.

Increasingly, alternative polymers, especially lower-cost alternatives that are less dense and more readily recyclable are being used for footwear applications, including for sole structures, such as plates for articles of footwear including plates including traction elements which are permanently attached to the plate (i.e., traction elements which are not configured to be removed or replaced). Use of alternative polymers having low surface energies and/or high levels of hydrophobicity such as thermoplastic polyolefin-based resins, make it difficult to form strong thermal bonds with conventional resins having high surface energies and/or low levels of hydrophobicity, such as thermoplastic polyurethane-based resins. Issues encountered with using these alternative polymers in footwear include that these polymers may not provide the durability needed for use as traction elements. For example, these alternative polymers may not be sufficiently durable when used to make traction elements (e.g., cleats or studs), including the ends of the traction elements which are configured to be directly ground-contacting during wear (e.g., blade tips, cleat tips and stud tips, which terms are understood to be used interchangeably herein). In conventional sole structures, it is not uncommon to use one resin (i.e., a first resin) to form all or part of the plate and a different (i.e., a second resin) to form all or part of the traction element. For example, the first resin may form all of the plate, the bulk of the plate, a base portion of the plate, the region of the plate where one or more traction element attaches to the plate, or any combination thereof. The second resin may form all of the traction element, the bulk of the traction element, a surface of the traction element which is thermally bonded to the first resin of the plate, a retention feature of the traction element configured to assist in permanently retaining the traction element in a plate, a stud tip, a stud shaft connecting the retention feature and the stud tip, or any combination thereof. There are many conventional resins which have been found to have the balance of properties needed to perform well as at least the ground-contacting portions of traction elements, such as stud shafts and/or stud tips. A number of these conventional resins are thermoplastic and have high surface energies and/or low levels of hydrophobicity, such as thermoplastic polyurethane-based resins. In conventional sole structures, the use of these high surface energy and/or low hydrophobicity resins has not created bonding issues with the base resin of the plate, as the base resin is typically also a thermoplastic high surface energy and/or low hydrophobicity resin, such as a thermoplastic polyurethane (TPU), and thermally bonding two thermoplastic resins having similar surface energies and/or levels of hydrophobicity, such as in an overmolding process, forms strong thermal bonds which are more than adequate to withstand the forces applied to the sole structure during normal wear. However, when a resin having high surface energies and/or low levels of hydrophobicity such as a thermoplastic polyurethane-based resin is used for traction elements, and the traction elements are thermally bonded to a thermoplastic resin a having low surface energy and/or a high level of hydrophobicity such as a thermoplastic polyolefin-based resin, to form the base of the plate, the thermal bonds formed between these two different resins are not strong enough on their own to withstand the forces required for footwear applications, resulting in the traction elements delaminating from the plate at the interface between the different resins, with the bonds failing after just a few hours of wear. In order to increase the strength of the thermal bonds between these resins having different surface energies and/or levels of hydrophobicity, it has been found that it is necessary to include a retention feature on an end of the traction element, where the retention feature is embedded into the plate structure in a molding process, and the thermoplastic resin of the retention feature is thermally bonded to the thermoplastic resin of the base plate. The thermal bond between the dissimilar thermoplastic resins can be formed as part of an over-molding process, in which the traction elements are first molded from one thermoplastic resin, and then molten low surface energy and/or high hydrophobicity resin is then applied to the retention feature of each traction element before the base plate is solidified in a mold.

As thermoplastic low surface energy and/or high hydrophobicity resins such as thermoplastic polyolefin-based resins are often more rigid but somewhat brittle and less elastomeric as compared to conventional thermoplastic high surface energy and/or low hydrophobicity resins such as thermoplastic polyurethane-based resins, the failure was primarily due to the embedded portion of the traction element pulling out of the plate or the traction element breaking off the plate. These were different modes of failure than were observed when thermoplastic resins having similar properties were used to form both the traction elements and the plate of the sole structures. Without being bound by theory, it is believed that by using relatively more elastomeric thermoplastic high surface energy and/or low hydrophobicity resins such as thermoplastic polyurethane-based resins were used for the retention features of the traction elements and relatively more rigid thermoplastic low surface energy and/or high hydrophobicity resins such as thermoplastic polyolefin-based resins were used for the plate, the more elastomeric resin of the retention feature of the traction element was more likely to elongate and partially or fully pull away from the more rigid resin of the plate. This pulling away from the more rigid resin of the plate also appeared to facilitate tearing of the traction element at its narrowest dimension, which was usually within the retention feature portion of the traction element.

Based on these observations of failure modes unique to this combination of dissimilar resins for the plate and traction elements, a variety of different designs for retention features were evaluated. In one aspect, the base of the retention feature of the one or more traction element may be a "wide" base, i.e., a base having a maximum width which is the same as or greater than a maximum width of a portion of the shaft of the traction element which is exposed in the sole structure. In another aspect, the retention feature may include a post connecting the exposed shaft of the traction element to the retention feature (e.g., to a flange or the base), or connecting one region of the retention feature to another region of the retention feature, such as connecting a flange to the base. The maximum width of the post is less than the maximum width of the two adjacent regions it connects. The post may be a "moderately thin" post having a minimum width ranging from 30 percent to 50 percent of a maximum width of each of the two adjacent retention features it connects. In yet another aspect, the retention feature may include one or more flanges along the length of the retention feature, where the flange is separated from other regions of the retention feature by a post region located on both sides of the flange. The maximum width of the flange is greater than the minimum width of both post regions adjacent to the flange. The flange may be a "moderately wide" flange having a maximum width at least 30 percent greater than a maximum width of both of the post regions adjacent to the flange. It was found that a traction element which includes a retention feature having a wide base and a moderately thin post withstood both pulling out of the plate and breaking off in the region of the post. In another aspect, the retention feature includes a wide base as described above, a moderately wide flange as described above, the moderately wide flange having a maximum width less than a maximum width of the wide base, a moderately thin first post connecting the exposed shaft and the flange, and a moderately thin second post connecting the flange and the base. This retention feature was found to be even less prone to failure by either pulling out of the base plate or breaking at the location of the first post of the retention feature.

For the purposes of this disclosure, the term "resin" is understood to refer to a polymeric composition including or consisting of one or more polymers. The polymeric component of a resin is understood to include all the polymers present in the resin. In addition to the one or more polymer, a resin may include a non-polymeric additive, such as a coloring agent, a processing aid, a filler, and the like. The "first resin" is understood to refer to a resin of the plate of the sole structure, such as a resin forming the bulk of the plate, or a resin forming the point of attachment of a traction element to the plate, or a resin which thermally bonds a surface of a traction element to a plate. In the context of the present disclosure, the "first resin" is also understood to be a thermoplastic resin exhibiting a low surface energy and/or high hydrophobicity, and includes or consists of one or more first polymer, wherein the one or more first polymer, in solid form at room temperature and atmospheric pressure, has a low surface energy, a high level of hydrophobicity, or both. In a particular example, the first resin includes one or more thermoplastic polyolefin (i.e., is a thermoplastic polyolefin-based resin). Other polymers exhibiting similarly low surface energies and/or similarly high levels of hydrophobicity as polyolefins are known in the art, and can be used in combination with, or in place of, the one or more thermoplastic polyolefin. The "second resin" is understood to refer to a resin of the traction element of the sole structure, such as a resin forming an entire traction element, or a resin forming at least a stud tip portion of the traction element, or a resin forming at least a retention feature portion of the traction element, or a resin defining a surface of a traction element, where the surface is thermally bonded to a first resin of a plate. In the context of the present disclosure, the "second resin" is also understood to be a thermoplastic resin exhibiting a high surface energy and/or low hydrophobicity, and includes or consists of one or more second polymer, wherein the one or more second polymer, in solid form at room temperature and atmospheric pressure, has a high surface energy, a low level of hydrophobicity, or both. In a particular example, the second resin includes or consists of one or more thermoplastic polyurethane (i.e., is a thermoplastic polyurethane-based resin). Other polymers exhibiting similarly high surface energies and/or similarly low levels of hydrophobicity as polyurethanes are known in the art, and can be used in combination with or in place of the one or more thermoplastic polyurethane.

A variety of different thermoplastic low surface energy and/or high hydrophobicity resins (i.e., first resins) can be used in accordance with this disclosure. The first resin can be a thermoplastic polyolefin-based resin including one or more thermoplastic polyolefin. The one or more thermoplastic polyolefin can include a polyolefin homopolymer, a polyolefin copolymer, or a combination of a polyolefin homopolymer and a polyolefin copolymer. The first resin can include a polymeric component including or consisting of one or more thermoplastic polyolefin. The one or more thermoplastic polyolefin can include a thermoplastic polyolefin elastomer. The one or more polyolefin can include or consist of a polyolefin homopolymer. The polyolefin homopolymer may include or consist of a polyethylene homopolymer, or a polypropylene homopolymer, or a combination of a polyethylene homopolymer and a polypropylene homopolymer. When the one or more polyolefin includes or consists of a polyolefin copolymer, the polyolefin copolymer may include a polyethylene copolymer, or a polypropylene copolymer, or a combination of a polyethylene copolymer and a polypropylene copolymer. In one aspect, the polyolefin copolymer may include a propylene-ethylene copolymer, particularly a random propylene-ethylene copolymer.

The first resin (i.e., the low surface energy and/or high hydrophobicity resin of the plate) can include a polymeric resin modifier in addition to the one or more polyolefin. In this aspect, the first resin can include the polymeric resin modifier in combination with one or more polyolefin homopolymer, with one or more polyolefin copolymer, or with a combination of one or more polyolefin homopolymer and one or more polyolefin copolymer. The polymeric resin modifier may include a propylene copolymer, particularly a propylene-ethylene copolymer including isotactic propylene units. The presence of the polymeric resin modifier in the resin can improve the resistance of the resin to stress-whitening or cracking, particularly under cold conditions. The improved resistance to stress-whitening or cracking can be demonstrated based on cold Ross flex testing.

The first resin (i.e., the low surface energy and/or high hydrophobicity resin of the plate) can include a thermoplastic vulcanizate in addition to the one or more polyolefin and a polymeric resin modifier. In this aspect, the first resin can include the thermoplastic vulcanizate in combination with one or more polyolefin homopolymer, with one or more polyolefin copolymer, or with a combination of one or more polyolefin homopolymer and one or more polyolefin copolymer. It has been found that by combining a thermoplastic vulcanizate (TPV) with a polyolefin copolymer the resulting resin is more durable and resistant to cracking and fracturing than resins without the TPV present. These more durable polyolefin-based resins are more resistant to "chunking", in which repeated impacts to the outer surface of the resin produce cracks and fractures which result in chunks of the resin falling off the outer surface of the resin. A relatively small amount of the TPV may be included in the first resin, such as at least 5 percent by weight, or at least 10 percent by weight, or at least 15 percent by weight, or at least 20 percent by weight, based on a total weight of the first resin. The polyolefin copolymer may include a propylene-ethylene copolymer, particularly a random propylene-ethylene copolymer. The TPV may include a crosslinked elastomer phase dispersed in a thermoplastic phase including a polyolefin, particularly a crosslinked propylene-based elastomer such as EPDM rubber dispersed in a thermoplastic phase including polypropylene. Optionally, in this aspect, the first resin can further include an optional polymeric resin modifier. The optional polymeric resin modifier may include a propylene copolymer, particularly a propylene-ethylene copolymer including isotactic propylene units.

A variety of different high surface energy and/or low hydrophobicity resins (i.e., second resins) can be used in accordance with this disclosure. The second resin can be a thermoplastic polyurethane-based resin including one or more polyurethane. The one or more polyurethane can include a polyurethane homopolymer (i.e., a polymer in which all the segments are polyurethane segments), a polyurethane copolymer (i.e., a polymer including polyurethane segments as well as non-polyurethane segments, such as polyester segments and/or polyether segments), or a combination of a polyurethane homopolymer and a polyurethane copolymer. The second resin can include a polymeric component including or consisting of one or more polyurethane. The polyurethane can include or consist of a polyurethane homopolymer. When the one or more polyurethane includes or consists of a polyurethane copolymer, the polyurethane copolymer may include a polyester-polyurethane copolymer, or a polyether-polyurethane copolymer, or a combination of a polyester-polyurethane copolymer and a polyether-polyurethane copolymer. In one aspect, the polyurethane copolymer may include a polyester-polyether-polyurethane copolymer, including a random polyester-polyether-polyurethane copolymer.

The present disclosure provides a variety of sole structures. As used herein, a sole structure is understood to refer to the portion of an article of footwear which is configured to be positioned under the foot of a wearer, including a component which may be used alone or in combination with other components to form an underfoot system. The sole structures described herein include a plate for an article of footwear, and one or more traction element affixed to a ground-facing side of the plate, wherein the one or more traction element is configured to be ground-contacting during wear of the article of footwear. In addition to plates and traction elements, other examples of components which may optionally be present in a sole structure include a cushioning structure, a heel clip, a toe bumper, and the like. The first resins described herein, such as a polyolefin-based resin as described herein, are appropriate for use in a plate of a sole structure, and may also be used in one or more optional component of the sole structure. The second resins described herein, such as a polyurethane-based resin as described herein, are appropriate for use in a traction element of a plate of a sole structure, including a stud tip with a retention feature, and may also be used in one or more optional components of the sole structure. The present disclosure also provides for methods of making these sole structures, and for making articles of footwear including these sole structures, particularly methods of manufacturing sole structures by injection molding a low surface energy and/or high hydrophobicity resin (i.e. a first resin) directly onto a retention feature of a traction element, wherein the retention feature includes or consists of a high surface energy and/or low hydrophobicity resin (i.e., a second resin).

In some aspects, this disclosure provides a sole structure for an article of footwear. The sole structure includes a plate including or consisting of a first resin, the plate having a first side and a second side, wherein the first side is configured to be ground-facing when the sole structure is a component of an article of footwear. The ground-facing side of the plate includes one or more traction elements configured to be ground-contacting. The one or more traction elements include a retention feature, a stud shaft, and a stud tip configured to be ground-contacting when the article of footwear is worn. The retention feature of the traction elements is embedded into and thermally bonded to the first resin of the plate. At least the surface of the retention feature embedded into and thermally bonded to the first resin of the plate is defined by the second resin. Optionally, the surface of the stud shaft, the surface of the stud tip, or both may also include or consist of the second resin. In a particular aspect, the entire traction element consists of the second resin. All of the traction elements of an individual sole structure, or only a portion of a plurality of traction elements of a plate, may include or consist of the second resin.

In various aspects, this disclosure also provides articles of footwear including a sole structure described herein, as well as methods of making a sole structure as described herein, and methods of making articles of footwear including an upper and a sole structure as described herein.

Before the present disclosure is described in greater detail, it is to be understood that this disclosure is not limited to particular aspects described, and as such may, of course, vary. Other systems, methods, features, and advantages of the disclosed resins and articles and components including these resins will be or become apparent to one with skill in the art upon examination of the following drawings and detailed description. It is intended that all such additional systems, methods, features, and advantages be included within this description, be within the scope of the present disclosure, and be protected by the accompanying claims. It is also to be understood that the terminology used herein is for the purpose of describing particular aspects only, and is not intended to be limiting. The skilled artisan will recognize many variants and adaptations of the aspects described herein. These variants and adaptations are intended to be included in the teachings of this disclosure and to be encompassed by the claims herein.

Sole Structures and Articles of Footwear Made Therefrom

In some aspects, the present disclosure is directed to sole structures including a plate including or consisting of a first resin and one or more traction element including or consisting of a second resin. The one or more traction element includes a retention feature including or consisting of the second resin. In the finished sole structures, the retention feature of the one or more traction element is embedded in the first resin of the plate, and the first resin and the second resin are thermally bonded to each other. The first and second resins differ from each other based on their properties. The first resin of the plate is a thermoplastic low surface energy and/or high hydrophobicity resin, while the second resin of the one or more traction elements is a thermoplastic high surface energy and/or low hydrophobicity resin. As discussed below, the sole structures containing these places with these traction elements desirably exhibit high levels of mechanical strength and yet flexural durability. The retention feature of the traction element is effective in increasing the strength of the bond between the first resin and the second resin, resulting in a sole structure which can withstand the forces applied during normal use of cleated footwear, while also providing a sole structure which is cost-effective to manufacture as it can be manufactured using conventional over-molding processes. The present disclosure also provides articles of footwear including the sole structures, methods of manufacturing the sole structures, and methods of manufacturing articles of footwear which include the sole structures.

Forming strong thermal bonds between surfaces of resins having very different properties presents challenges, particularly when the thermal bonds need to withstand the forces applied to cleated footwear during wear, and to withstand these forces after many hours of use under both hot and cold conditions, as may be encountered when playing games in which cleated footwear is often worn (such as American football or global football, i.e., soccer/futbol, baseball, softball, ultimate frisbee, golf, and the like) either on hard ground, natural turf, or artificial turf on very hot and very cold days. Conventionally, in the footwear industry, this issue of thermally bonding resins having very different properties has been avoided by using resins having similar properties to form all the components which are thermally bonded to each other, and using adhesive systems to bond resins having dissimilar properties. These approaches limit the spectrum of resins which can be thermally bonded together, and require the use of labor-intensive stock fitting processes to form adhesive bonds. Increasingly, concerns over using more sustainable, less carbon emission-intensive materials and simpler, less energy-intensive and labor-intensive manufacturing processes have led footwear manufacturers to try to incorporate alternative polymers into footwear and footwear manufacturing processes. One effort to use these alternative polymers has led to the solutions described herein, which allow dissimilar resins to form strong thermal bonds with each other, and to allow these dissimilar resins to be used to produce high-performance sole structures in efficient over-molding manufacturing processes.

FIG. 1A is a lateral side perspective view of an exemplary cleated article of athletic footwear 110, for example a soccer/futbol boot. As seen in FIG. 1A, the article of footwear 110 includes an upper 112 and a sole structure 113, which includes a plate 116. Optionally, a textile 114 is disposed on the upper side 152 of the plate. The textile 114 is located between the plate 116 and the upper 112. The plate 116 includes a plurality of traction elements 118. When worn, traction elements 118 provide traction to a wearer so as to enhance stability. One or more of the traction elements 118 is integrally formed with the plate (i.e., the one or more traction element is thermally bonded to and embedded in the plate), as illustrated in FIG. 1A. In addition to the one or more integrally formed traction element, optionally, the sole structure may further include one or more removable traction element (not illustrated). Each of the one or more traction element 118 can include a traction element tip (e.g., a stud tip) (not pictured) configured to be ground-contacting during wear of the article of footwear. The stud tip can be formed of the same resin as other portions of the traction element 118. Optionally, the traction element tip can be formed of a different resin than other portions of the traction element 118.

Figure 1B:
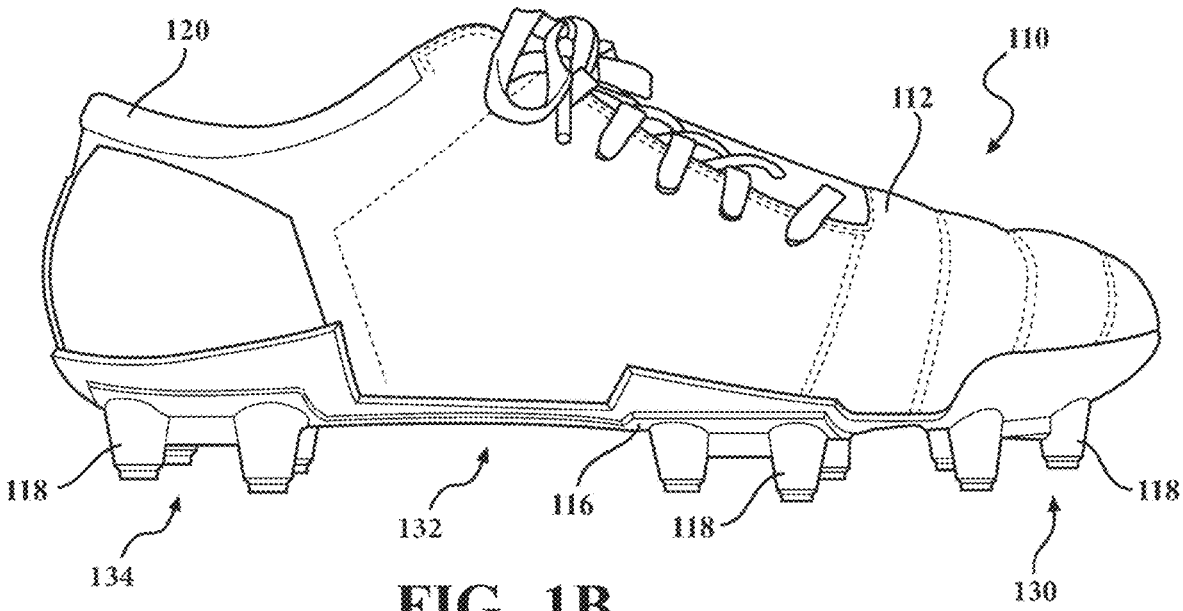
FIG. 1B is a lateral side elevational view of the exemplary article of athletic footwear.
Figure 1C:
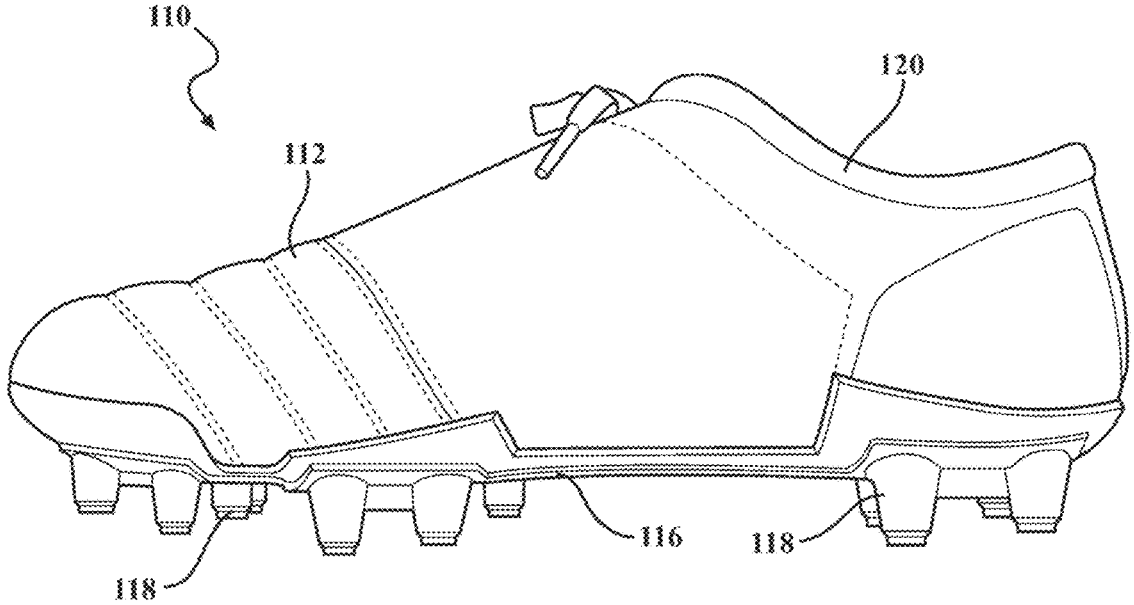
FIG. 1C is a medial side elevational view of the exemplary article of athletic footwear.
Figure 1D:
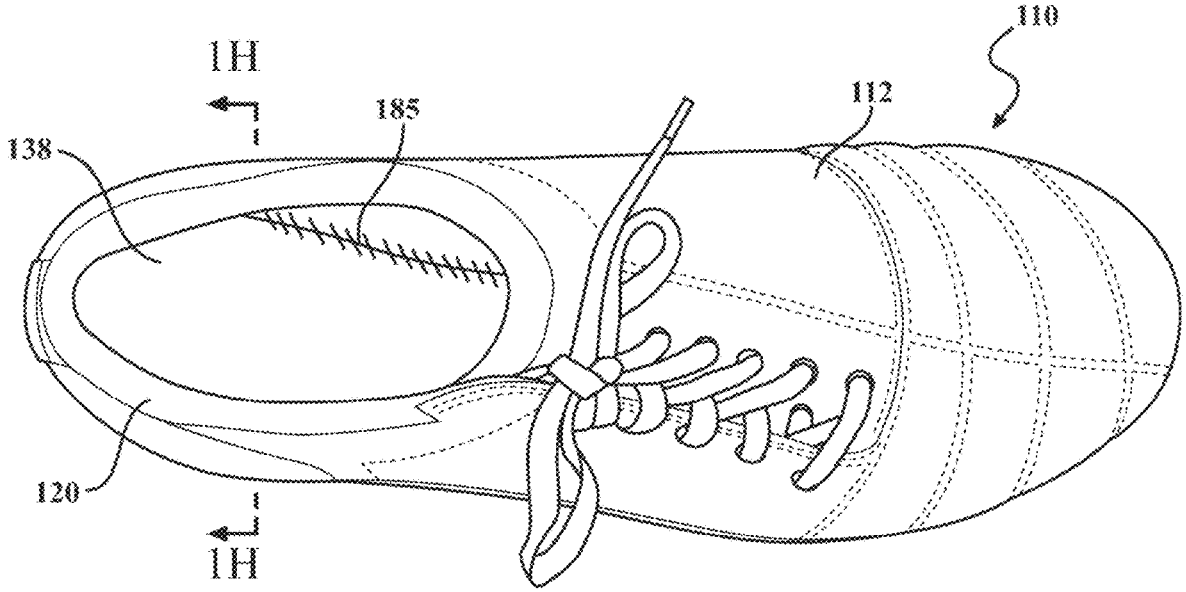
FIG. 1D is a top view of the exemplary article of athletic footwear.
Figure 1E:
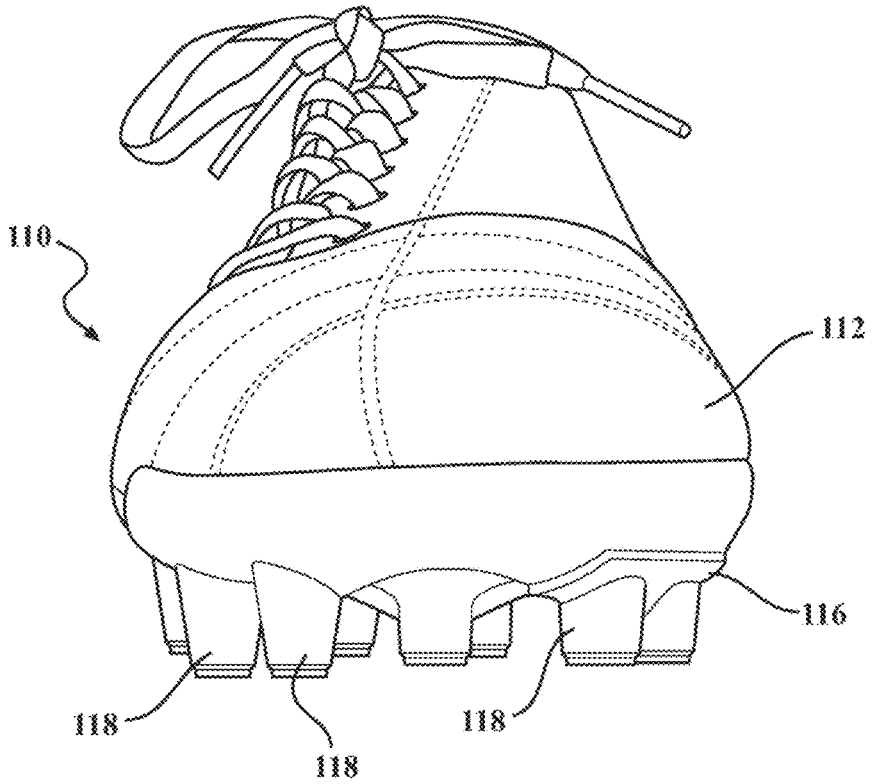
FIG. 1E is a front view of the exemplary article of athletic footwear.
Figure 1F:
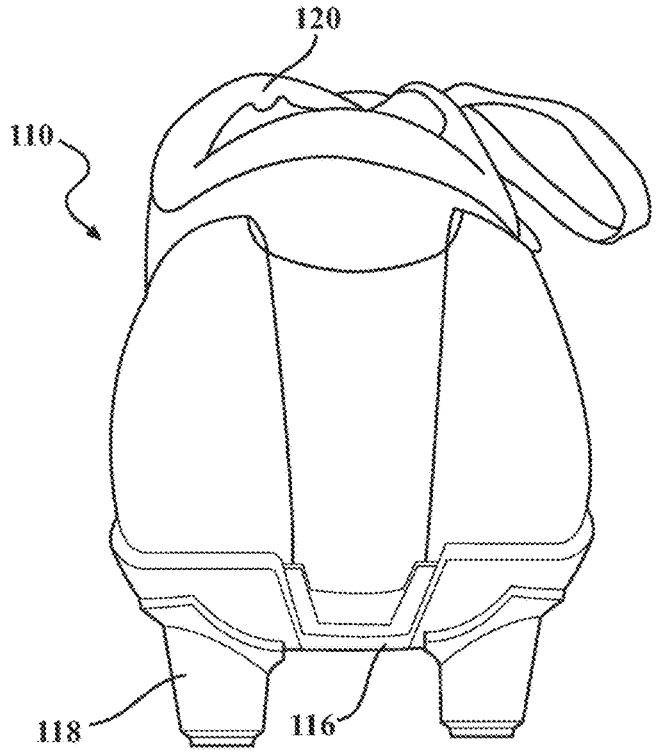
FIG. 1F is a rear view of the exemplary article of athletic footwear.

FIG. 1B is a lateral side elevational view of article of footwear 110. When the article of footwear 110 is worn, the lateral side of the footwear 110 is generally oriented on the side facing away from the centerline of the wearer's body. FIG. 1C is a medial side elevational view of the article of footwear 110. When the article of footwear 110 is worn, the medial side generally faces toward the centerline of the wearer's body. FIG. 1D is a top view of the article of footwear 110, and further shows upper 112 (with no sock liner in place). Upper 112 includes a padded collar 120. Alternatively or in addition, the upper can include a region configured to extend up to or over a wearer's ankle (not illustrated). In at least one aspect, upper 112 is tongueless, with the upper wrapping from the medial side of the wearer's foot, over the top of the foot, and under the lateral side portion of the upper, as illustrated in FIG. 1D. Alternatively, the article of footwear can include a tongue (not illustrated). As illustrated in FIG. 1A-1G, the laces of the article of footwear 110 optionally can be located on the lateral side of the article. In other examples, the article of footwear may have a slip-on design or may include a closure system other than laces (not illustrated). FIG. 1E and FIG. 1F are, respectively, front and rear elevational views of the article of footwear 110.

Figure 1G:
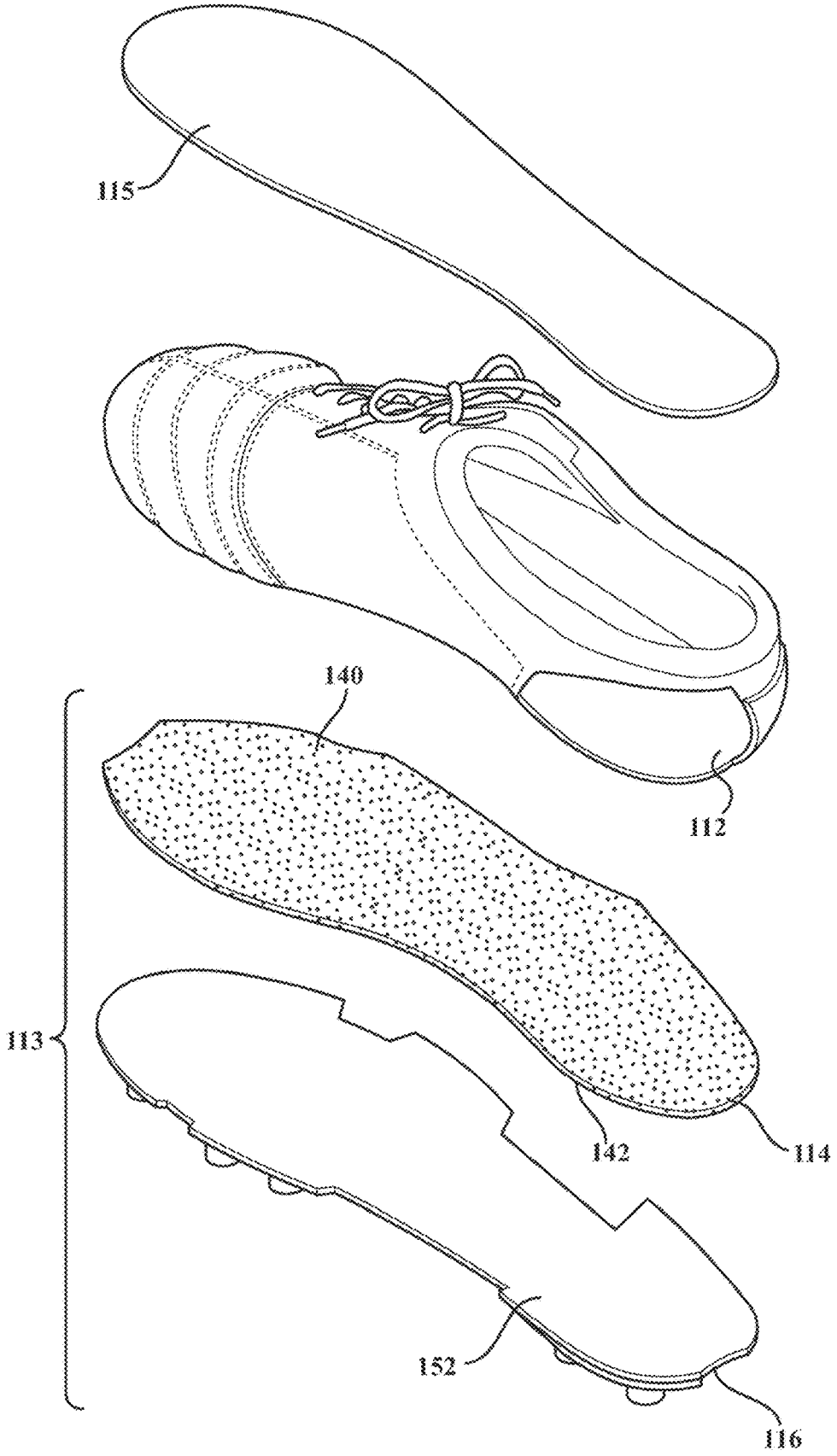
FIG. 1G is an exploded perspective view of the exemplary article of athletic footwear.
Figure 1H:
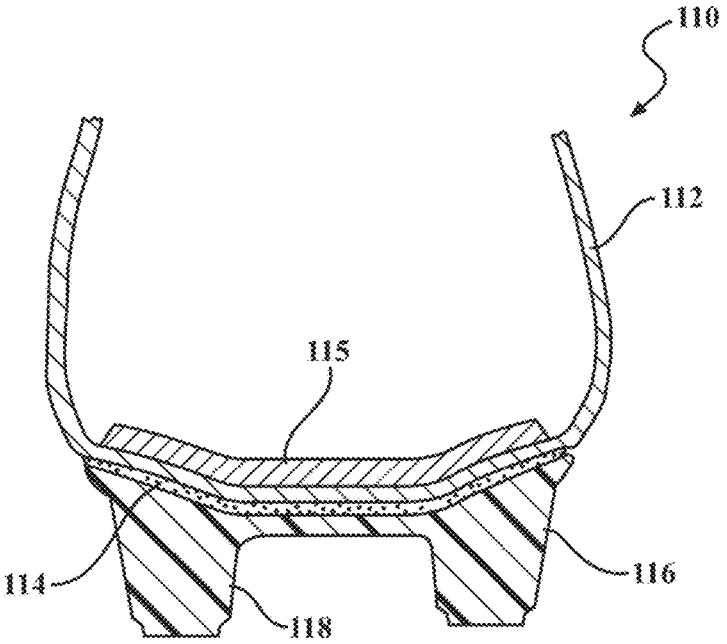
FIG. 1H is a sectional view along Line 1H-1H in FIG. 1D.

FIG. 1G is an exploded perspective view of the article of footwear 110 showing upper 112, plate 116, and a lasting board or textile 114. As seen in FIG. 1D, upper 112 includes a strobel 138, although the strobel is optional and may be omitted. As illustrated in FIG. 1D, the strobel 138 is roughly the shape of a wearer's foot, and closes the bottom of the upper 112, and is stitched to other components to form the upper 112 along the periphery of the strobel 138 with stitching 185. Optionally, a lasting board or other board-like member 115 can be located above or below the strobel 138. The lasting board or other board-like member 115 can extend substantially the entire length of the plate, or can be present in a portion of the length of the plate, such as, for example, in the toe region 130, or in the midfoot region 132, or in the heel region 134. However, due to the rigidity and strength of the first resins described herein, it is typically not necessary to include a lasting board or other board-like member, so the article of footwear may be free of a lasting board. Upper 112 including optional strobel 138 may be bonded to the upper surface 140 of the optional textile 114 (FIGS. 1G and 1H), or the upper 112 (with or without optional strobel 138) may be bonded directly to the plate, such as thermally bonded directly to the plate by the first resin of the plate. When present, the lower surface 142 of the optional textile 114 may be bonded to the upper surface 152 of the plate 116 by thermal bonding (e.g., melting and/or softening the different resins so that the polymers present in the different resins become entangled with each other across an interface between the different resins), by injection molding the polyolefin-based resin of the plate directly onto the textile. Alternatively, the upper 112 may be adhesively bonded to the plate 116 using a polymeric adhesive. The lower surface 142 of the optional textile 114 may be thermally bonded to the upper surface 152 of the plate 116 by melding polymers in the textile 114 and the first resin of the plate 116, or by applying a polymeric adhesive. Alternatively or in addition, upper 112 including optional strobel 138 may be thermally bonded to the upper surface 140 of the textile 114 by melding polymers of the upper 112 or strobel 138 with the first resin of the plate 116, or by applying an adhesive, such as a water-borne adhesive conventionally used in footwear manufacturing.

Figure 2A:
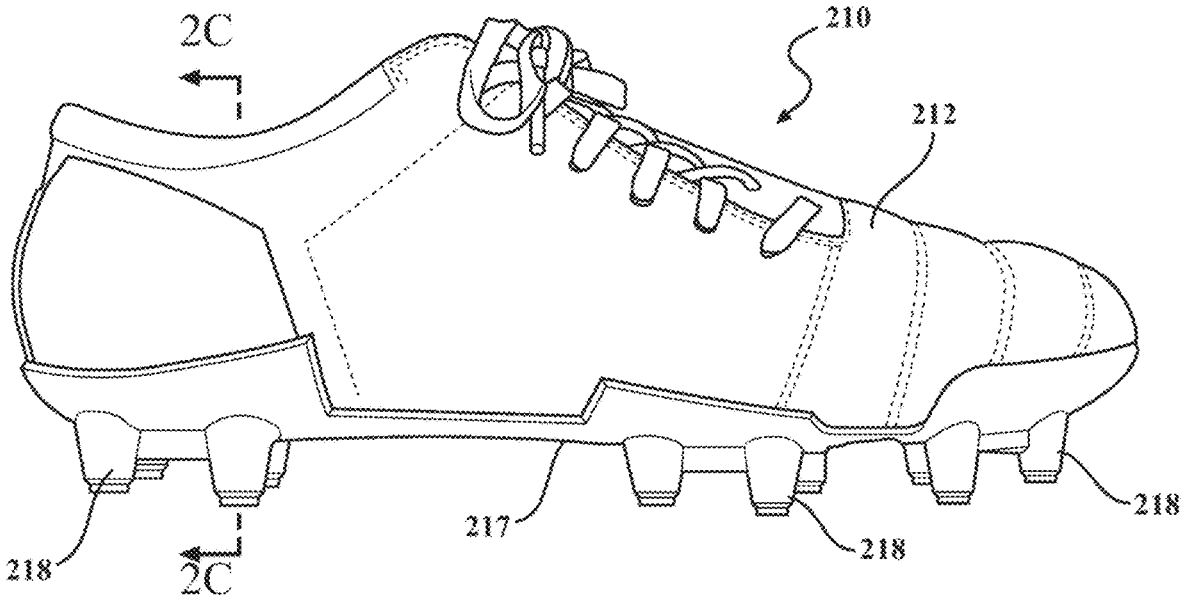
FIG. 2A is a lateral side elevational view of the exemplary article of athletic footwear.
Figure 2B:
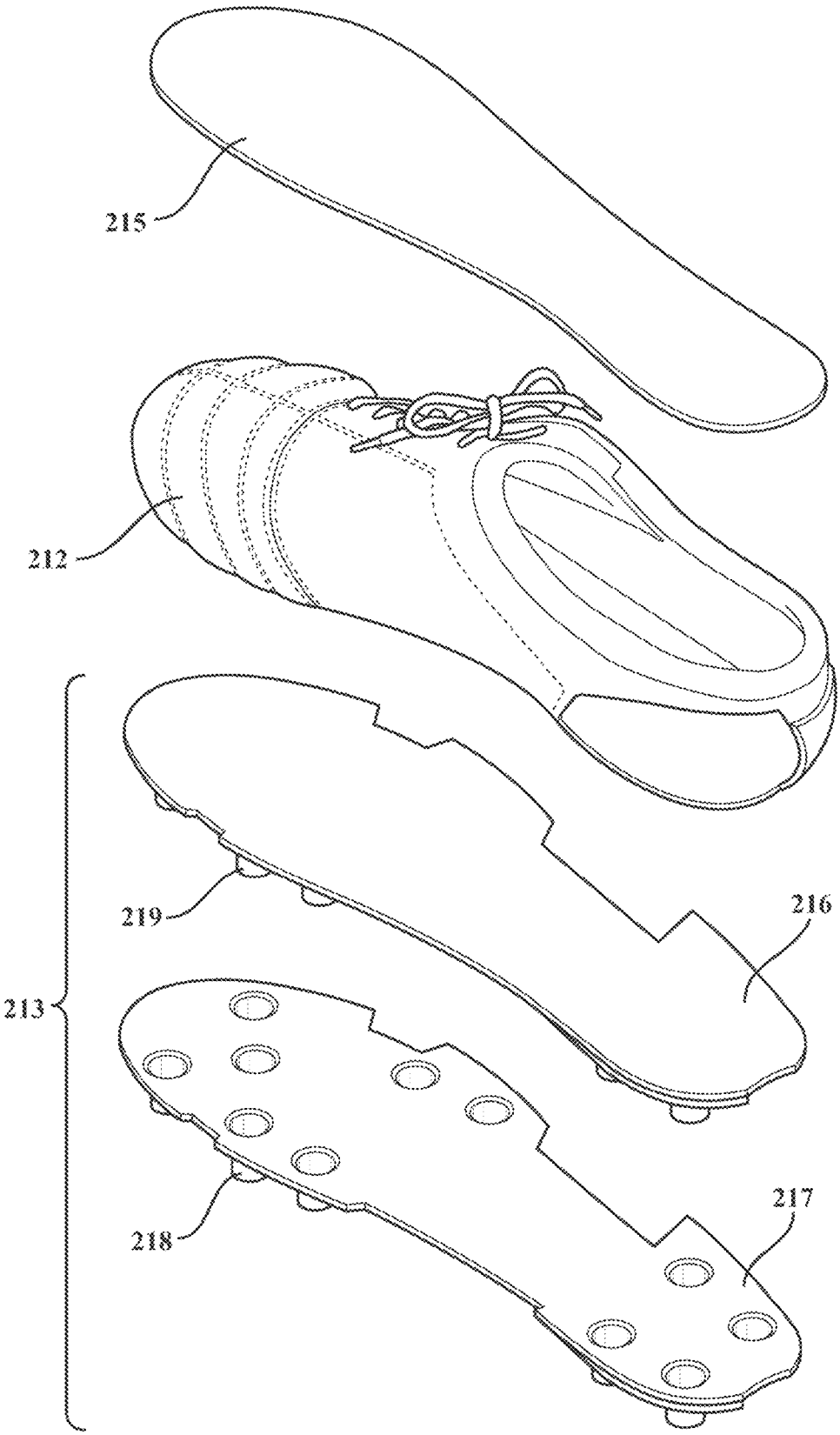
FIG. 2B is an exploded perspective view of the second exemplary article of athletic footwear.
Figure 2C:
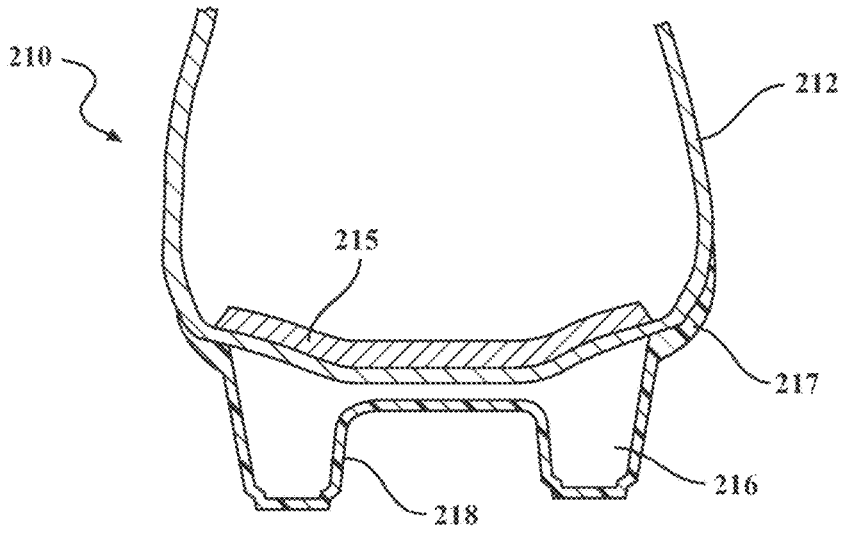
FIG. 2C is a sectional view along Line 2C-2C in FIG. 2A.

With reference to FIGS. 2A-2C, an article of footwear 210 is provided. In view of the substantial similarity in structure and function of the components associated with the article of footwear 110, like reference numerals are used hereinafter and in the drawings to identify like components while like reference numerals. Namely, one hundred (100) is added to the corresponding reference number from the article of footwear 110 to identify like components in the article of footwear 210. FIG. 2A is a lateral side elevational view of the exemplary article of athletic footwear. FIG. 2B is an exploded perspective view of the second exemplary article of athletic footwear. FIG. 2C is a sectional view along Line 2C-2C of the second exemplary article of athletic footwear. FIG. 2A is a lateral side elevational view of an exemplary article of footwear 210 that does not have a textile.

The article of footwear 210 includes an upper 212 and a sole structure 213 having a plate 216 and an optional chassis 217. Optionally, the chassis 217 may include multiple traction elements 218, or the plate 216 may include one or more traction element 219, or both the chassis 217 and the plate 216 may include one or more traction element. Optionally, the chassis 217 may provide an outer layer for a traction element 219 integrally formed with or thermally bonded to the plate 216, or the chassis may include openings through which a traction element 219 of the plate 216 passes. Optionally, the one or more traction element 218 can be formed entirely from the chassis 217 material or, as pictured in FIG. 2B, the one or more traction element 218 can have a corresponding inner traction element 219 that is formed in the plate 216 and encased by the chassis 217. Optionally, one or more of the traction elements 218 can include a traction element tip (e.g., a stud tip) (not pictured) configured to be ground-contacting. The article of footwear 210 optionally may include a lasting board member 215 which may extend substantially the entire length of the plate 216.

Figure 3:
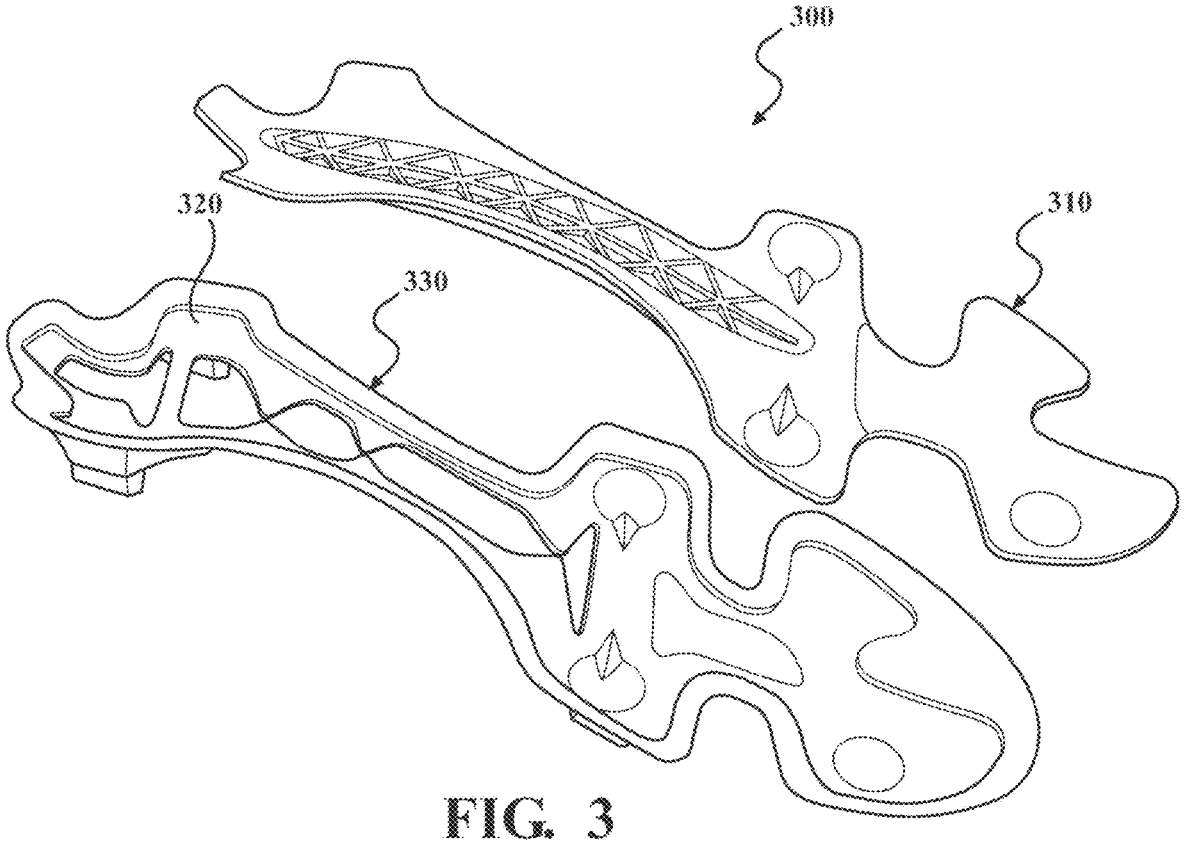
FIG. 3 depicts an exploded view of a third exemplary sole structure having a chassis and a rigid plate providing rigidity without adding substantial amounts of extra material, and therefore maintaining a low weight.

The sole structure includes a plate to provide rigidity, strength, and/or support without substantially adding weight. For example, some exemplary sole structure aspects may include a plate having certain features that provide resistance to vertical bending, lateral bending, and/or torsion. As depicted in FIG. 3, the plate 300 can include a reinforcing rib 310 longitudinally along the plate. The reinforcing rib can include a hollow structure, and thus, may provide rigidity without adding substantial amounts of extra material, and therefore maintains a low weight. Optionally, the plate 300 can sit within a chassis 330, for example with a recess 320 in the chassis 330.

Figure 4A:
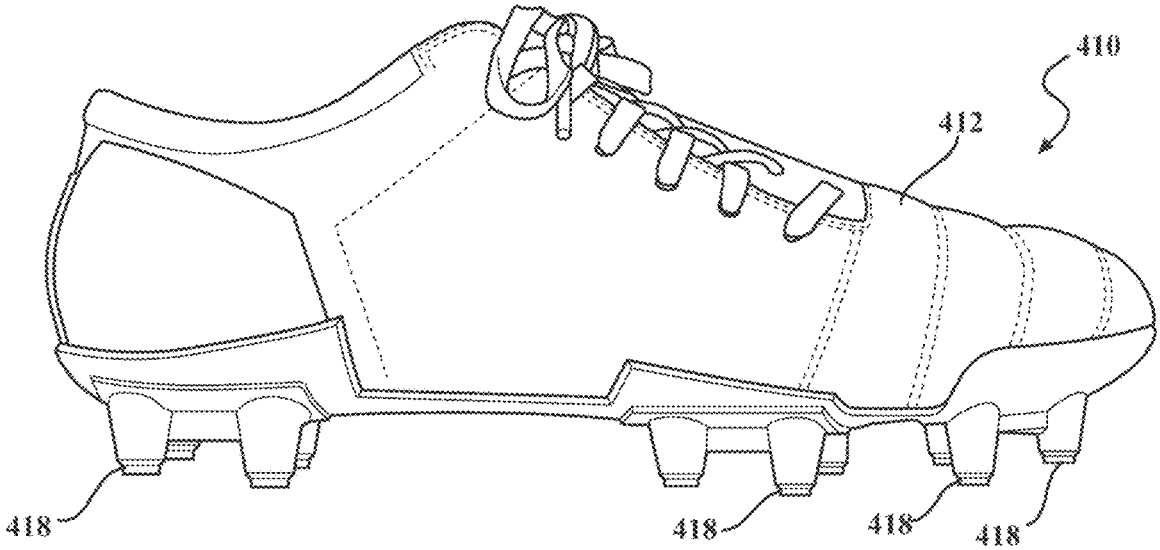
FIG. 4A is a lateral side elevational view of the fourth exemplary article of athletic footwear.
Figure 4B:
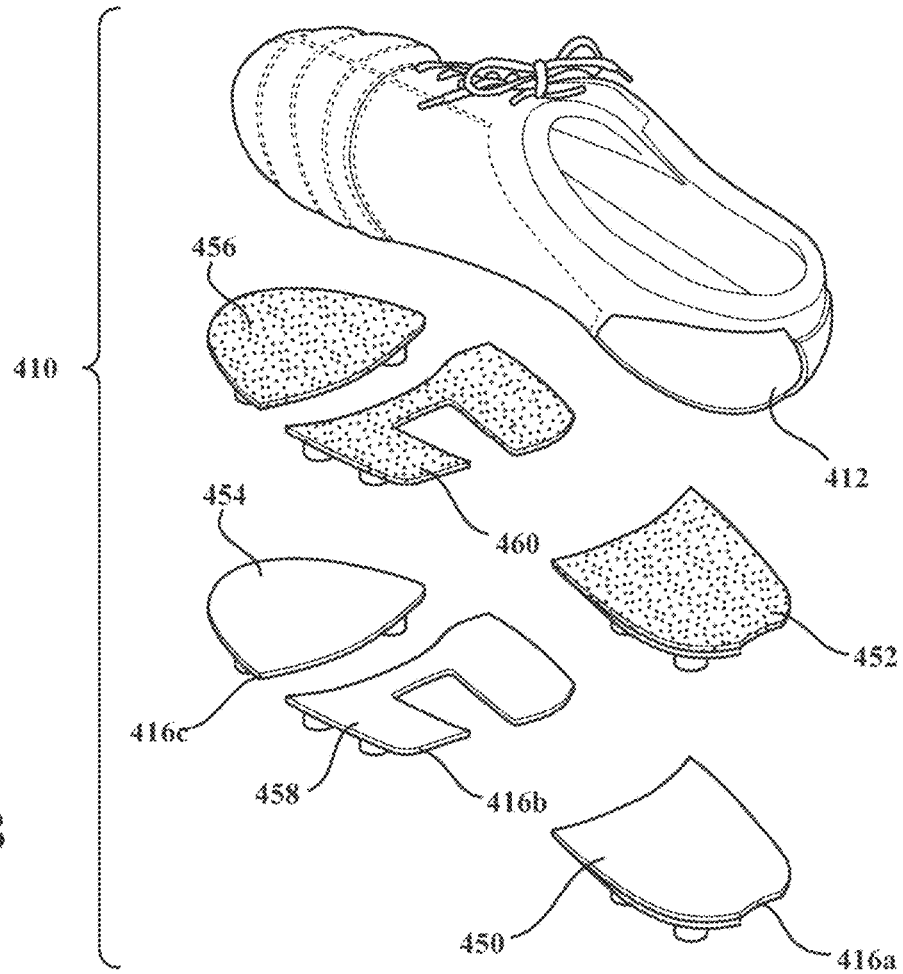
FIG. 4B is an exploded perspective view of the fourth exemplary article of athletic footwear.

FIG. 4A is a lateral side elevational view of an exemplary article of footwear 410 including a separate heel plate 416*a*, midfoot plate 416*b*, and toe plate 416*c*. Each of the heel plate 416*a*, midfoot plate 416*b*, and toe plate 416*c* include multiple traction elements 418. When worn, traction elements 418 provide traction to a wearer so as to enhance stability. One or more traction element 418 is integrally formed with the heel plate 416*a*, midfoot plate 416*b*, and/or toe plate 416*c*, as illustrated in FIG. 4A. FIG. 4B is an exploded perspective view of the article of footwear 410 showing upper 412, heel plate 416*a*, midfoot plate 416*b*, and toe plate 416*c*. In this aspect, upper surface 450 of the heel plate 416*a* can include an optional heel textile 452. An upper surface 454 of the toe plate 416*c* can include an optional toe textile 456. Likewise, an upper surface 458 of the midfoot plate 416*b* can include an optional midfoot textile 460. The optional textiles can provide for improved bonding between the upper 412, and one or more of the plates, i.e., heel plate 416*a*, midfoot plate 416*b*, and toe plate 416*c*.

With reference now to FIGS. 5A-9D, various configurations of traction elements are described and are drawn to scale. In view of the substantial similarity in structure and function of the components associated with each of the traction elements 600*a*-600*e*, like reference numerals are used hereinafter and in the drawings to identify like components while like reference numerals containing letter extensions are used to identify those components that have been modified.

Figure 5A:
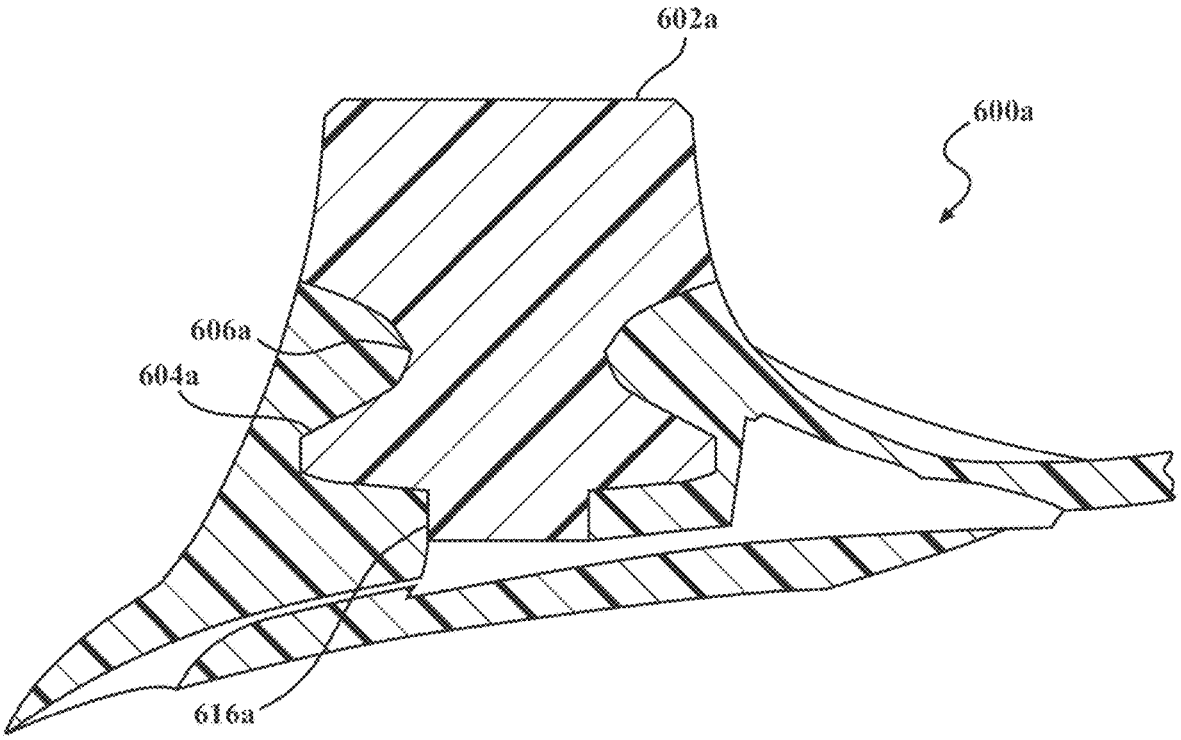
FIG. 5A is an enlarged partial cross-sectional view of a traction element in a plate for the article of footwear.
Figure 5B:
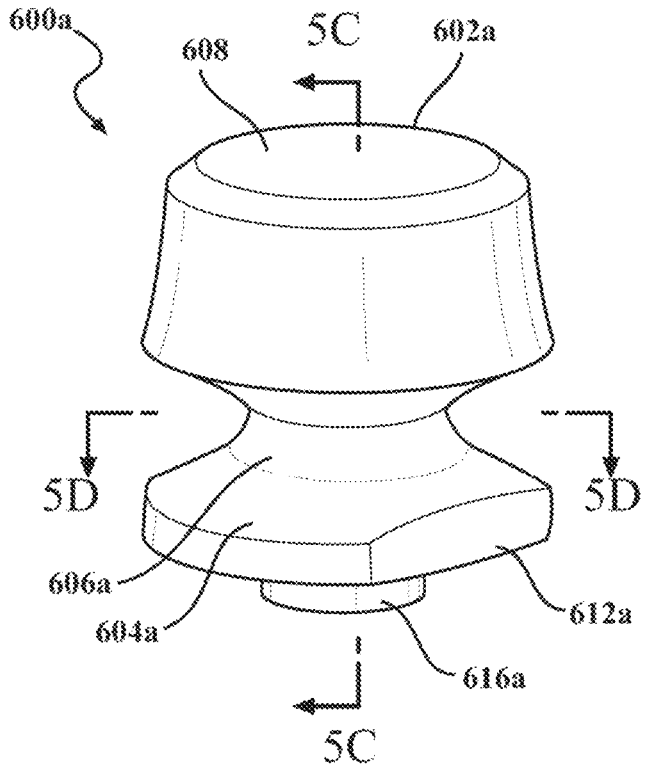
FIG. 5B is a side perspective view of the traction element of FIG. 5A.
Figure 5C:
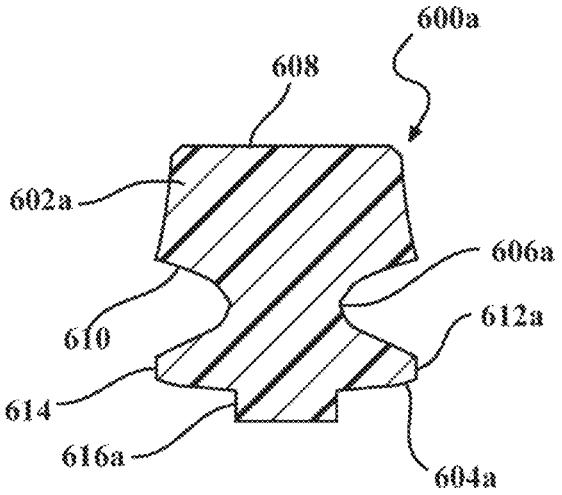
FIG. 5C is a cross-sectional view of the traction element taken along Line 5C-5C in FIG. 5B.
Figure 5D:
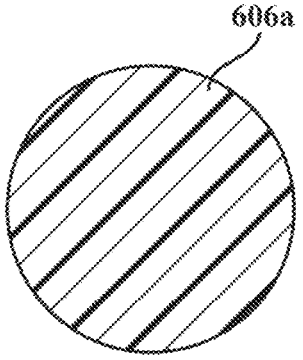
FIG. 5D is a cross-sectional view of the traction element taken along Line 5D-5D in FIG. 5B.
Figure 6A:
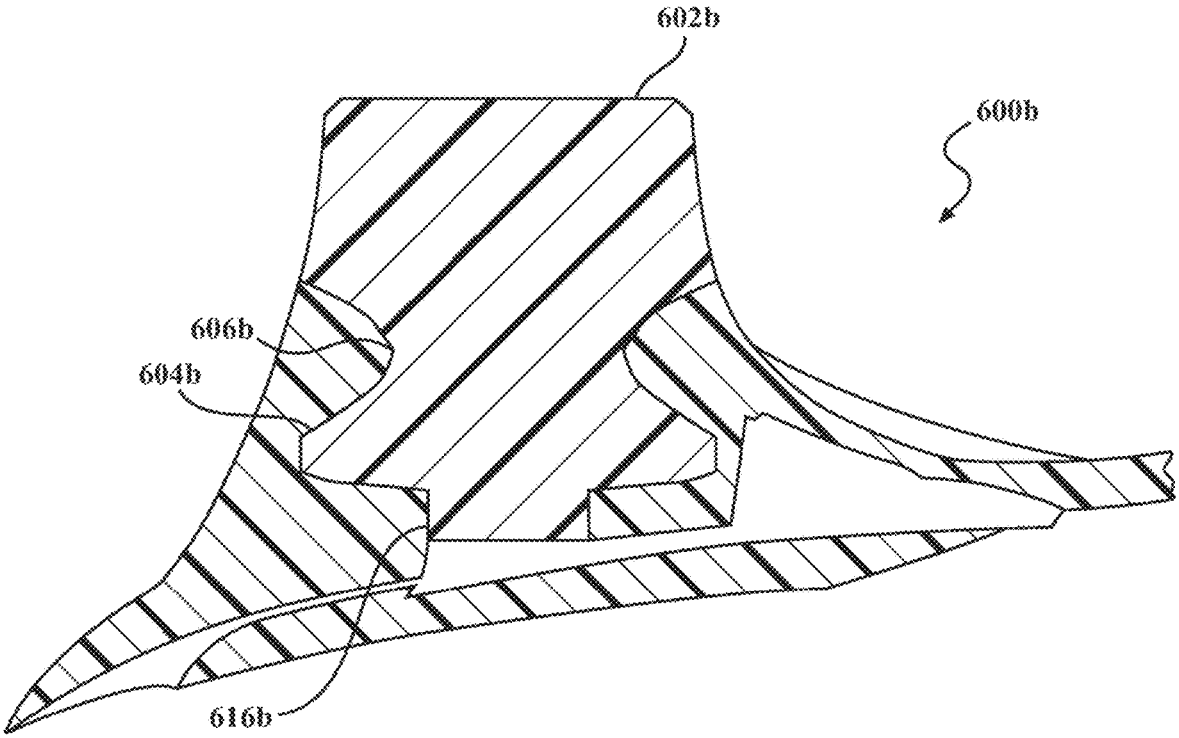
FIG. 6A is an enlarged partial cross-sectional view of a traction element in a plate for the article of footwear.
Figure 6B:
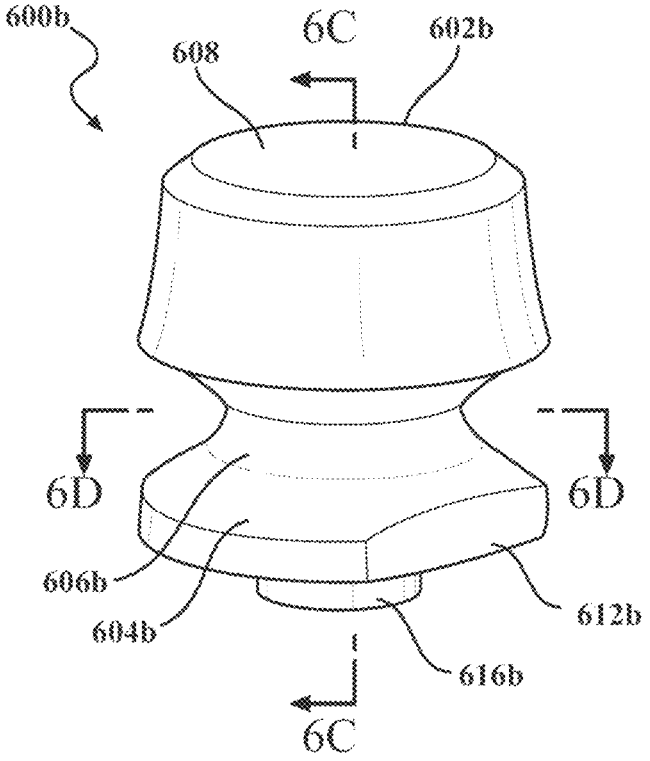
FIG. 6B is a side perspective view of the traction element of FIG. 6A.
Figure 6C:
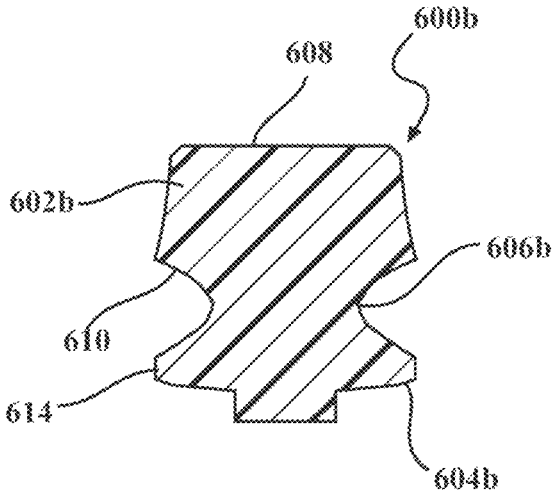
FIG. 6C is a cross-sectional view of the traction element taken along Line 6C-6C in FIG. 6B.
Figure 6D:
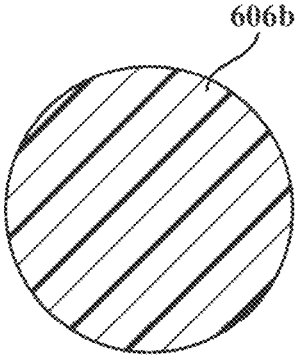
FIG. 6D is a cross-sectional view of the traction element taken along Line 6D-6D in FIG. 6B.

With specific reference to FIGS. 5A-5D, a traction element 600*a* of the present disclosure is illustrated to scale and includes a stud tip 602*a* coupled to a retention feature 604*a* via a stud shaft 606*a*. As depicted, the stud tip 602*a* has a generally frustoconical shape, such that a first end 608 of the stud tip 602*a* has a diameter less than an opposite second end 610 of the stud tip 602*a*. As shown in FIGS. 5A and 5C, the stud shaft 606*a* may be cylindrical, may be connected to the second end 610 of the stud tip 602*a* at a first end, and may be connected to the retention feature 604*a* at a second end. The stud shaft 606*a* may include an arcuate shape that tapers in a direction from the second end 610 toward the retention feature 604*a* and in a direction from the retention feature 604*a* toward the second end 610. In so doing, the stud shaft 606*a* includes a reduced diameter at a location between the second end 610 and the retention feature 604*a*.

The retention feature 604*a* includes a substantially circular cross section and has a larger diameter than the stud shaft 606*a*. In one configuration, the retention feature 604*a* includes an arcuate surface formed at a junction of the retention feature 604*a* and the stud shaft 606*a* and a substantially planar surface 612*a* disposed on an opposite side of the retention feature 604*a* than the arcuate surface. A perimeter edge 614 of the retention feature 604*a* is defined between the arcuate surface and the planar surface 612*a*. Finally, a cylindrical base 616*a* extends from the planar surface 612*a* in a direction away from the first end 608. As shown, the cylindrical base 616*a* provides the traction element 600*a* with a reduced diameter when compared to the diameter of the opposite, first end 608.

With specific reference now to FIGS. 6A-6D, a traction element 600*b* is illustrated to scale and has a similar configuration as the traction element 600*a*. The traction element 600*b* includes a stud tip 602*b*, a retention feature 604*b*, and a stud shaft 606*b* extending therebetween. As depicted, the stud tip 602*a* has a generally frustoconical shape, such that a first end 608 of the stud tip 602*b* has a diameter less than an opposite second end 610 of the stud tip 602*b*. As described with respect to the traction element 600*a*, the stud shaft 606*b* has a generally cylindrical cross section and an arcuate profile. The stud shaft 606*b* has a greater diameter as compared to the stud shaft 606*a*, such that the arcuate profile of the stud shaft 606*b* has a shallower depth than the stud shaft 606*a*.

The retention feature 604*b* includes an arcuate surface formed at a junction of the retention feature 604*b* and the stud shaft 606*b* and a substantially planar surface 612*b* disposed on an opposite side of the retention feature 604*b* than the arcuate surface. A perimeter edge 614 of the retention feature 604*b* is defined between the arcuate surface and the planar surface 612*b*. Finally, a cylindrical base 616*b* extends from the planar surface 612*b* in a direction away from the first end 608. As shown, the cylindrical base 616*b* provides the traction element 600*b* with a reduced diameter when compared to the diameter of the opposite, first end 608.

Figure 7A:
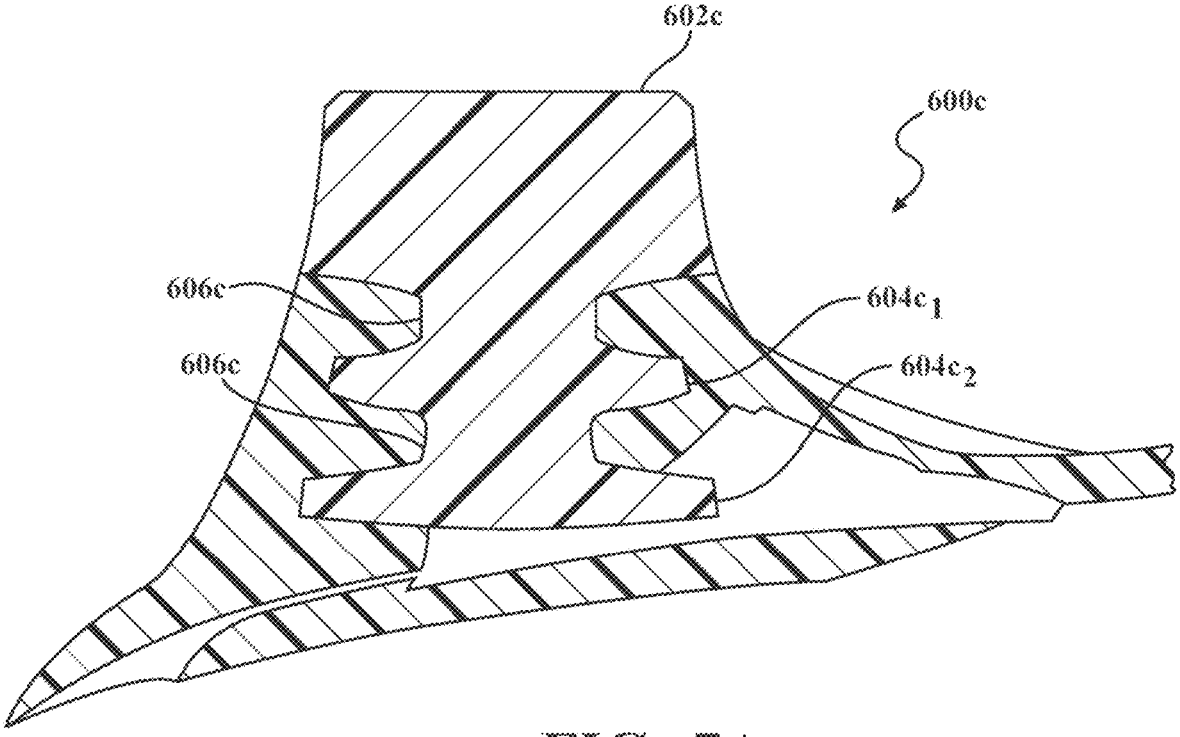
FIG. 7A is an enlarged partial cross-sectional view of a traction element in a plate for the article of footwear.
Figure 7B:
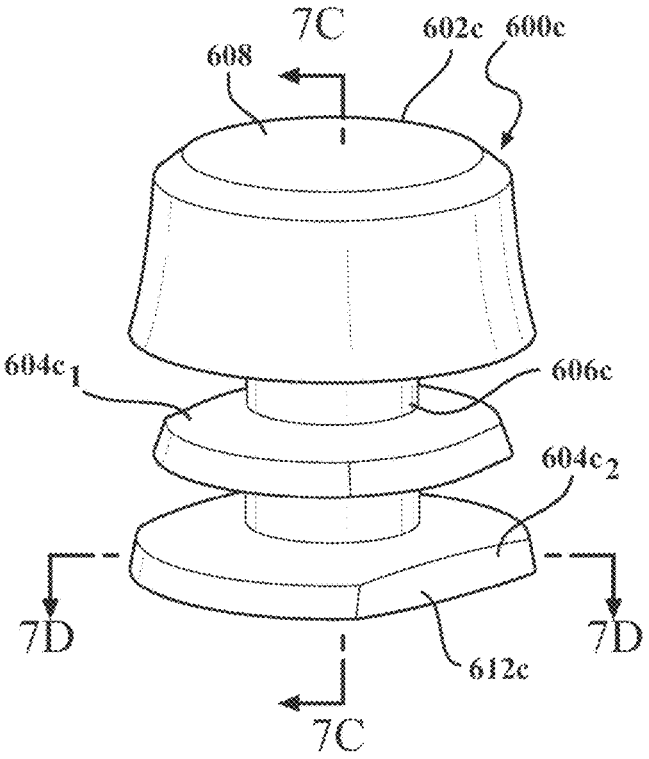
FIG. 7B is a side perspective view of the traction element of FIG. 7A.
Figure 7C:
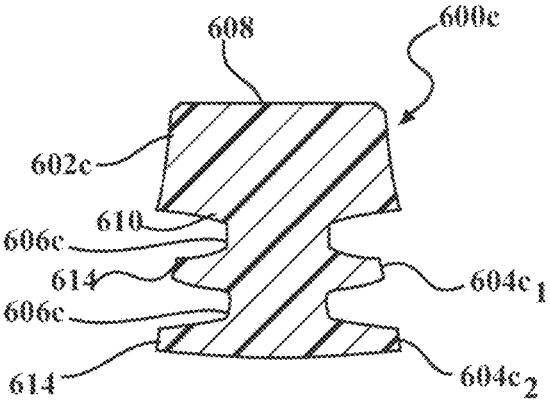
FIG. 7C is a cross-sectional view of the traction element taken along Line 7C-7C in FIG. 7B.
Figure 7D:
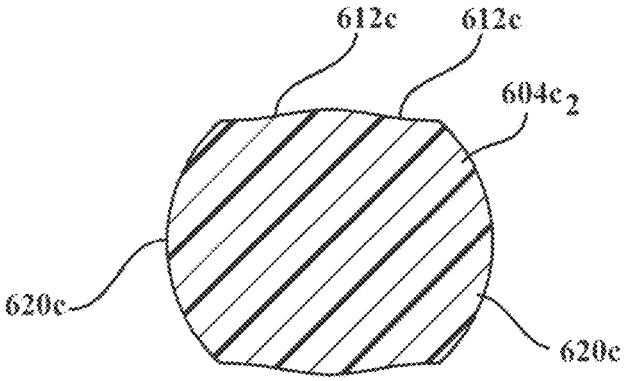
FIG. 7D is a cross-sectional view of the traction element taken along Line 7D-7D in FIG. 7B.

Referring now to FIGS. 7A-7D, a traction element 600*c* is illustrated to scale and includes a stud tip 602*c*, first and second retention features 604*c*1, 604*c*2, and a stud shaft 606*c*. The stud tip 602*c* is generally configured with a frustoconical shape, such that a first end 608 of the stud tip 602*c* has a diameter less than an opposing second end 610 of the stud tip 602*c*. The stud shaft 606*c* extends between the second end 610 of the stud tip 602*c* and the first retention feature 604*c*1. The stud shaft 606*c* also extends between the first retention feature 604*c*1 and the second retention feature 604*c*2. As best depicted in FIGS. 7A and 7C, the stud shaft 606*c* may taper in a direction from the second end 610 to the first retention feature 604*c*1. Accordingly, a diameter of the stud shaft 606*c* proximate to the second end 610 of the stud tip 602*c* is greater than a diameter of the stud shaft 606*c* proximate to the first retention feature 604*c*1. It is also contemplated that the retention features 604*c*1, 604*c*2 may taper in thickness in a direction away from the stud shaft 606*c*, such that a thickness of a central region of the retention features 604*c*1, 604*c*2, proximate to the stud shaft 606*c*, is greater than a thickness of a perimeter edge 614 of the retention features 604*c*1, 604*c*2. The retention features 604*c*1, 604*c*2 are also illustrated as including a plurality of converging planar portions 612*c* located on opposite sides of each retention feature 604*c*1, 604*c*2 and between curved portions 620*c* of the perimeter edge 614 of each retention feature 604*c*1, 604*c*2.

Figure 8A:
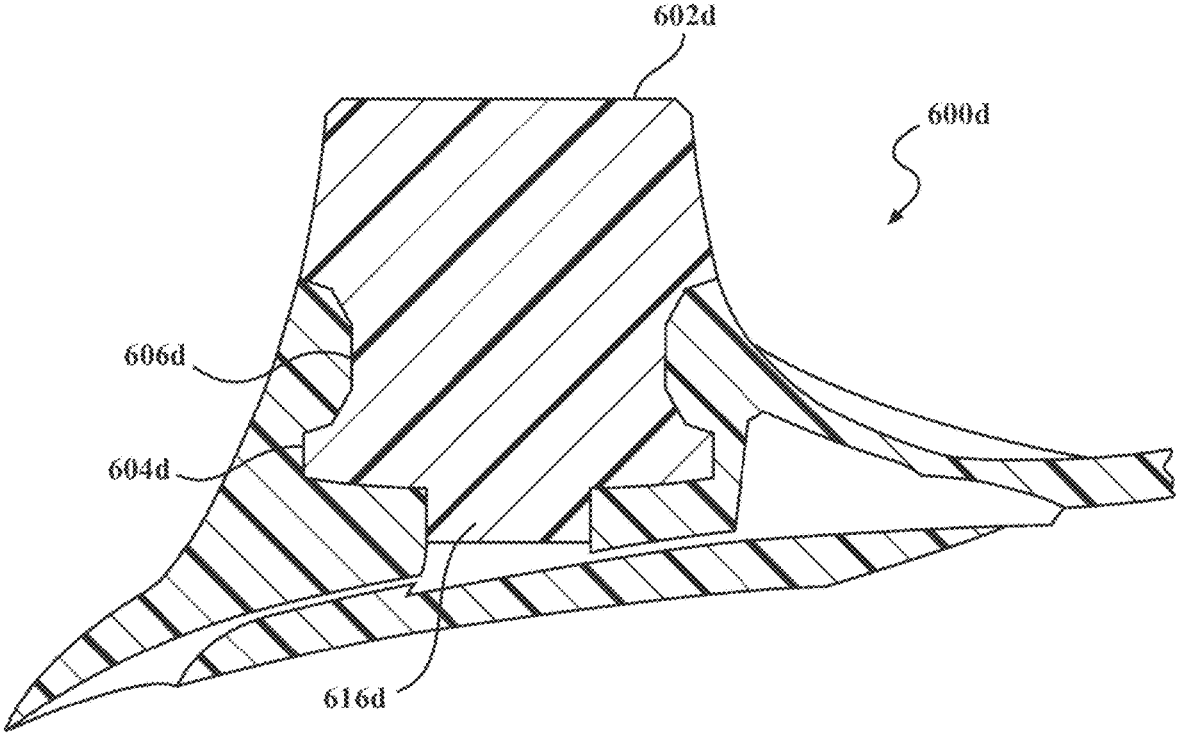
FIG. 8A is an enlarged partial cross-sectional view of a traction element in a plate for the article of footwear.
Figure 8B:
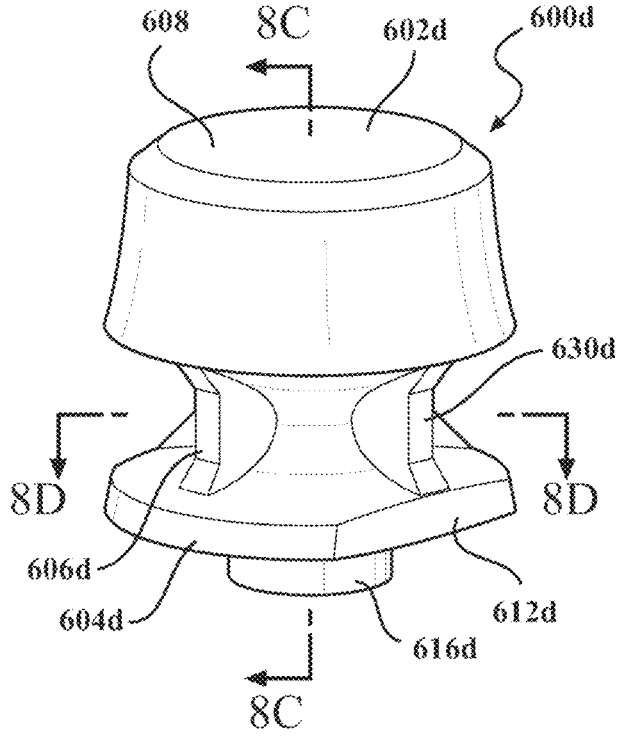
FIG. 8B is a side perspective view of the traction element of FIG. 8A.
Figure 8C:
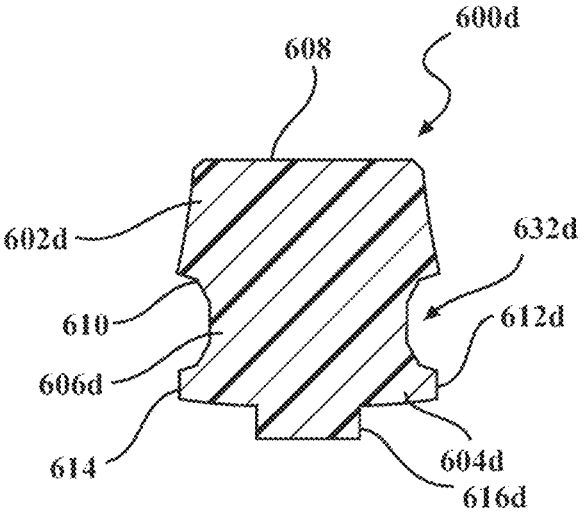
FIG. 8C is a cross-sectional view of the traction element taken along Line 8C-8C in FIG. 8B.
Figure 8D:
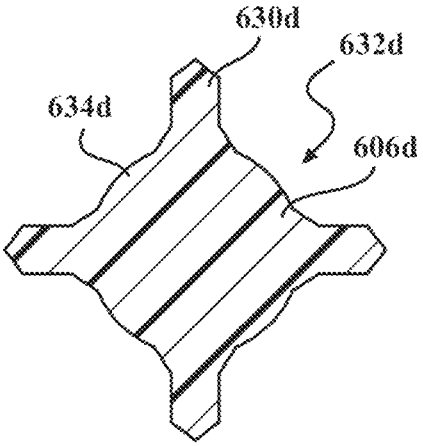
FIG. 8D is a cross-sectional view of the traction element taken along Line 8D-8D in FIG. 8B.
Figure 9A:
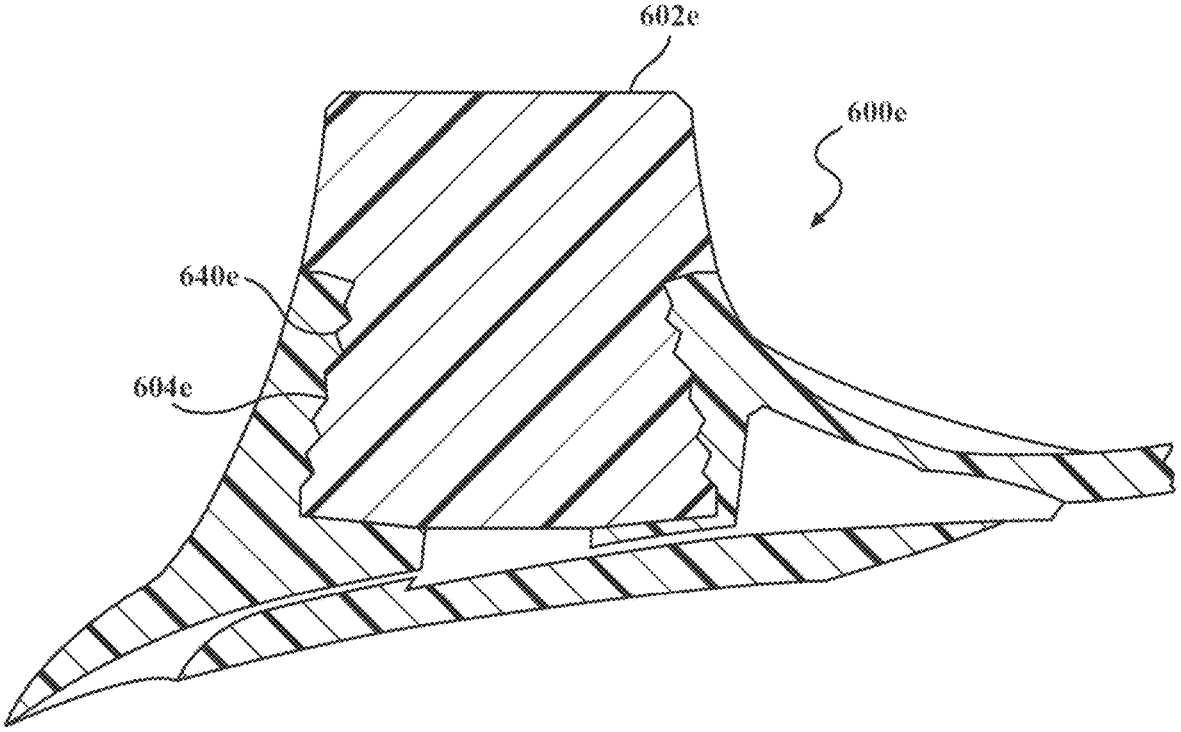
FIG. 9A is an enlarged partial cross-sectional view of a traction element in a plate for the article of footwear.
Figure 9B:
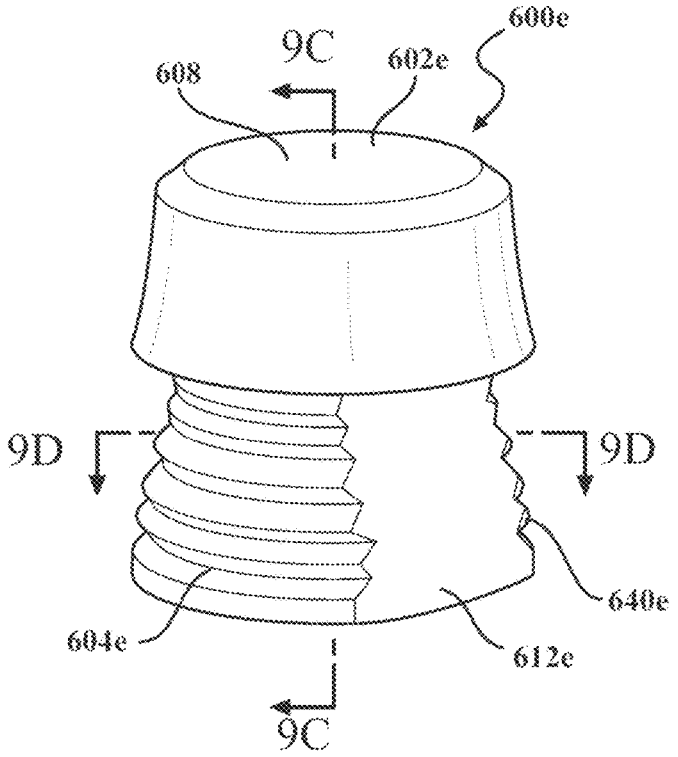
FIG. 9B is a side perspective view of the traction element of FIG. 9A.
Figure 9C:
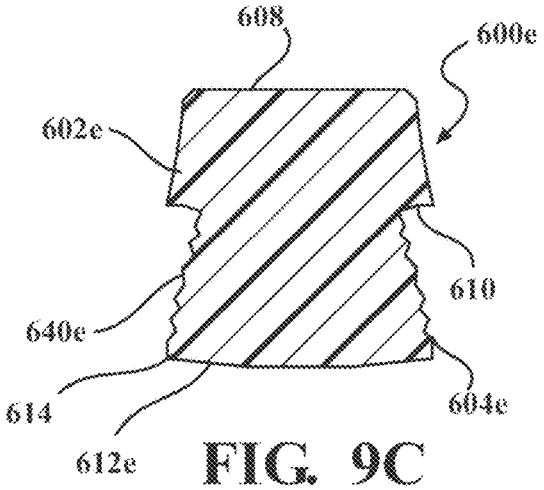
FIG. 9C is a cross-sectional view of the traction element taken along Line 9C-9C in FIG. 9B.
Figure 9D:
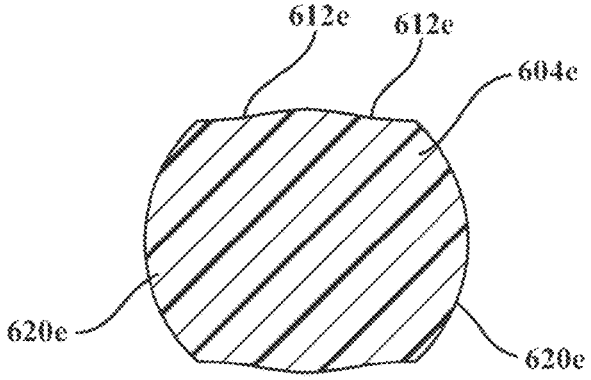
FIG. 9D is a cross-sectional view of the traction element taken along Line 9D-9D in FIG. 9B.

With reference now to FIGS. 8A-8D, a traction element 600*d* is drawn to scale and includes a stud tip 602*d*, a retention feature 604*d*, and a stud shaft 606*d* extending therebetween. As depicted, the stud tip 602*d* has a generally frustoconical shape, such that a first end 608 of the stud tip 602*d* has a diameter less than an opposite second end 610 of the stud tip 602*d*. As best illustrated in FIGS. 8B and 8D, the traction element 600*d* is shown as including a plurality of spines 630*d* extending from the stud shaft 606*d*. Each of the plurality of spines 630*d* has a generally arcuate profile, and each of the spines 630*d* is separated by a recess 632*d* defined between adjacent spines 630*d* of the stud shaft 606*d*. The stud shaft 606*d* includes curved portions 634*d* within each recess 632*d* and spaced apart from the spines 630*d*. As described herein, the stud tip 602*d* generally has a frustoconical configuration, and the retention feature 604*d* extends from the stud shaft 606*d* as a flange. As with the retention feature 604*a*, the retention feature 604*d* includes a planar portion 612*d* defined along a perimeter edge 614 and a cylindrical base 616*d* located on an opposite side of the retention feature 604*d* than the stud shaft 606*d*.

Referring now to FIGS. 9A-9D, a traction element 600*e* is illustrated to scale and includes a stud tip 602*e* and a retention feature 604*e* extending from the stud tip 602*e*. As described herein, the stud tip 602*e* has a generally frustoconical shape, such that a first end 608 of the stud tip 602*e* has a diameter less than an opposing second end 610 of the stud tip 602*e*. The retention feature 604*e* is also illustrated as having a generally frustoconical configuration. The retention feature 604*e* includes curved portions 620*e* and converging planar portions 612*e* disposed along a perimeter edge 614 thereof. The planar portions 612*e* extend along a length of the retention feature 604*e* with a pair of planar portions 612*e* being located on opposite sides of the retention feature 604*e* and separated by curved portions 620*e*. As illustrated in FIGS. 9A-9D, the curved portions 620*e* include a plurality of ribs 640*e* extending along the length L of the retention feature 604*e*.

This disclosure provides a variety of sole structures including a plate including or consisting of a first resin and one or more traction element including or consisting of a second resin. The first resin of the present disclosure, or the second resin of the present disclosure, or both, may include one or more elastomeric polymers (i.e., elastomers). An "elastomer" may be defined as a material having an elongation at break greater than 400 percent as determined using ASTM D-412-98 at 25 degrees Celsius.

The sole structure may optionally include a chassis. The chassis can be configured to be on the first side or ground facing side of the plate. In some aspects, the chassis is configured to wrap around the plate and to engage or be attached to an upper when the sole structure is a component of an article of footwear. The chassis can attach to the upper at the bite line.

The sole structures disclosed herein include one or more traction element, wherein the one or more traction element includes or consists of a second resin. In many aspects, the sole structures include a plurality of traction elements. The sole structure includes the one or more traction elements on its ground-facing side. The ground-facing side of the plate of the sole structure includes the one or more traction element, and the one or more traction element is configured to be ground-contacting during wear. Specifically, at least the stud tip portion of the one or more traction elements is configured to be ground-contacting during wear. In one aspect, the plate includes a plurality of traction elements, and each of the plurality of traction elements include or consist of the same second resin. Alternatively, only a portion of the plurality of traction elements may include or consist of the same second resin. The plate may include one or more traction element including or consisting of the first resin of the plate. The one or more traction element including or consisting of the first resin of the plate may be integrally formed with plate. With regard to the one or more traction element including or consisting of the second resin, at least a portion of the one or more traction element may include the second resin. In other words, at least one region of the one or more traction element includes the second resin. The at least one region including the second resin includes a surface of a retention feature of the traction element. The retention feature is configured to be embedded into and thermally bonded to the first resin of the plate. Other regions of the traction element which can also include or consist of the second resin include a stud shaft, a stud tip, or both.

Polymers

The resins described herein include polymers. The polymers may include polymers of the same or different types of monomers (e.g., homopolymers and copolymers, including terpolymers). In certain aspects, the thermoplastic polymer can include different monomers randomly distributed in the polymer (e.g., a random copolymer). The term "polymer" refers to a polymerized molecule having one or more monomer species that can be the same or different. When the monomer species are the same, the polymer can be termed homopolymer and when the monomers are different, the polymer can be referred to as a copolymer. The term "copolymer" is a polymer having two or more types of monomer species, and includes terpolymers (i.e., copolymers having three monomer species). In an aspect, the "monomer" can include different functional groups or segments, but for simplicity is generally referred to as a monomer.

For example, the polymer having a high surface energy and/or a low hydrophobicity (i.e., of the second resin) may be a polymer having repeating polymeric units of the same chemical structure (segments) which are relatively harder (hard segments), and repeating polymeric segments which are relatively softer (soft segments). In various aspects, the polymer has repeating hard segments and soft segments, physical crosslinks can be present within the segments or between the segments or both within and between the segments. Particular examples of hard segments include isocyanate segments. Particular examples of soft segments include an alkoxy group such as polyether segments and polyester segments. As used herein, the polymeric segment can be referred to as being a particular type of polymeric segment such as, for example, an isocyanate segment (e.g., diisocyanate segment), an alkoxy polyamide segment (e.g., a polyether segment, a polyester segment), and the like. It is understood that the chemical structure of the segment is derived from the described chemical structure. For example, an isocyanate segment is a polymerized unit including an isocyanate functional group. When referring to polymeric segments of a particular chemical structure, the polymer can contain up to 10 mole percent of segments of other chemical structures. For example, as used herein, a polyether segment is understood to include up to 10 mole percent of non-polyether segments.

The one or more thermoplastic polymer having high surface energy and/or low hydrophobicity (e.g., of the second resin) may be a thermoplastic polyurethane (also referred to as "TPU"). The thermoplastic polyurethane may be a thermoplastic polyurethane elastomer. The thermoplastic polyurethane may include hard and soft segments. The hard segments may include or consist of isocyanate segments (e.g., diisocyanate segments), and the soft segments may include or consist of alkoxy segments (e.g., polyether segments, or polyester segments, or a combination of polyether segments and polyester segments). The thermoplastic polyurethane may include or consist of a thermoplastic polyurethane elastomer having repeating hard segments and repeating soft segments.

The resins described herein may include polyamides. The polyamides may include a thermoplastic polyamide, or an elastomeric polyamide, or a thermoplastic polyamide elastomer. The polyamide can be a polyamide homopolymer having repeating polyamide segments of the same chemical structure. Alternatively, the polyamide can include a number of polyamide segments having different polyamide chemical structures (e.g., polyamide 6 segments, polyamide 11 segments, polyamide 12 segments, polyamide 66 segments, etc.). The polyamide segments having different chemical structures can be arranged randomly, or can be arranged as repeating blocks. The polyamide may be a block co-polyamide, such as a polyether block amide (PEBA) copolymer.

The polymer may include a polyester, including a thermoplastic polyester. The polyester may be a polybutylene terephthalate (PBT), a polytrimethylene terephthalate, a polyhexamethylene terephthalate, a poly-1,4-dimethylcyclohexane terephthalate, a polyethylene terephthalate (PET), a polyethylene isophthalate (PEI), a polyarylate (PAR), a polybutylene naphthalate (PBN), a liquid crystal polyester, or a blend or mixture of two or more of the foregoing. The polyester may be a co-polyester (i.e., a co-polymer including polyester segments and non-polyester segments). The co-polyester can be an aliphatic co-polyester (i.e., a co-polyester in which both the polyester segments and the non-polyester segments are aliphatic). Alternatively, the co-polyester may include aromatic segments. The polyester segments of the co-polyester can include or consist of polyglycolic acid segments, polylactic acid segments, polycaprolactone segments, polyhydroxyalkanoate segments, polyhydroxybutyrate segments, or any combination thereof. The polyester segments of the co-polyester can be arranged randomly, or can be arranged as repeating blocks.

Polyolefins

The polymers of the first resins described herein may include or consist of polyolefins, including thermoplastic polyolefins and thermoplastic polyolefin elastomers. Exemplary polyolefins may include, but are not limited to, polyethylene, polypropylene, and thermoplastic polyolefin elastomers (e.g., metallocene-catalyzed block copolymers of ethylene and α-olefins having 4 to about 8 carbon atoms). The polyolefin may be a polymer selected from a polyethylene, an ethylene-α-olefin copolymer, an EPDM rubber, a polybutene, a polyisobutylene, a poly-4-methylpent-1-ene, a polyisoprene, a polybutadiene, an ethylene-methacrylic acid copolymer, and a polyolefin elastomer such as a dynamically cross-linked polymer obtained from polypropylene (PP) and an EPDM rubber, and blends or mixtures of the foregoing. Further exemplary polyolefins useful in the disclosed compositions are polymers of cycloolefins such as cyclopentene or norbornene.

It is to be understood that polyethylene, which optionally can be crosslinked, is inclusive a variety of polyethylenes, including, but not limited to, low density polyethylene (LDPE), linear low density polyethylene (LLDPE), (VLDPE) and (ULDPE), medium density polyethylene (MDPE), high density polyethylene (HDPE), high density and high molecular weight polyethylene (HDPE-HMW), high density and ultrahigh molecular weight polyethylene (HDPE-UHMW), and blends or mixtures of any the foregoing polyethylenes. A polyethylene can also be a polyethylene copolymer derived from monomers of mono-olefins and diolefins copolymerized with a vinyl, acrylic acid, methacrylic acid, ethyl acrylate, vinyl alcohol, and/or vinyl acetate. Polyolefin copolymers including vinyl acetate-derived units can be a high vinyl acetate content copolymer, e.g., greater than about 50 wt. percent vinyl acetate-derived composition.

The thermoplastic polyolefin, as disclosed herein, may be formed through free radical, cationic, and/or anionic polymerization by methods well known to those skilled in the art (e.g., using a peroxide initiator, heat, and/or light). In a further aspect, the disclosed thermoplastic polyolefin can be prepared by radical polymerization under high pressure and at elevated temperature. Alternatively, the thermoplastic polyolefin can be prepared by catalytic polymerization using a catalyst that normally contains one or more metals from group IVb, Vb, VIb or VIII metals. The catalyst usually has one or more than one ligand, typically oxides, halides, alcoholates, esters, ethers, amines, alkyls, alkenyls and/or aryls that can be either p- or s-coordinated complexed with the group IVb, Vb, VIb or VIII metal. In various aspects, the metal complexes can be in the free form or fixed on substrates, typically on activated magnesium chloride, titanium(III) chloride, alumina, or silicon oxide. It is understood that the metal catalysts can be soluble or insoluble in the polymerization medium. The catalysts can be used by themselves in the polymerization or further activators can be used, typically a group Ia, IIa and/or IIIa metal alkyls, metal hydrides, metal alkyl halides, metal alkyl oxides or metal alkyloxanes. The activators can be modified conveniently with further ester, ether, amine, or silyl ether groups.

Suitable polyolefins can be prepared by polymerization of monomers of mono-olefins and diolefins as described herein. Exemplary monomers that can be used to prepare disclosed polyolefin include, but are not limited to, ethylene, propylene, 1-butene, 1-pentene, 1-hexene, 2-methyl-1-propene, 3-methyl-1-pentene, 4-methyl-1-pentene, 5-methyl-1-hexene and mixtures thereof.

Suitable ethylene-α-olefin copolymers can be obtained by copolymerization of ethylene with an α-olefin such as propylene, butene-1, hexene-1, octene-1,4-methyl-1-pentene, or the like having carbon numbers of 3 to 12.

Suitable dynamically cross-linked polymers can be obtained by cross-linking a first component such as a soft segment while at the same time physically dispersing a second component such as a hard segment by using a kneading machine such as a Banbury mixer and a biaxial extruder. The dynamically cross-linked polymers can then be ground, and the ground material can be dispersed in a thermoplastic polymer phase to form the TPV.

The polyolefin may be a mixture of polyolefins, such as a mixture of two or more polyolefins disclosed herein above. For example, a suitable mixture of polyolefins can be a mixture of polypropylene with polyisobutylene, polypropylene with polyethylene (for example PP/HDPE, PP/LDPE) or mixtures of different types of polyethylene (for example LDPE/HDPE).

The polyolefin may be a copolymer of suitable monolefin monomers or a copolymer of a suitable mono-olefin monomer and a vinyl monomer. Exemplary polyolefin copolymers include, but are not limited to, ethylene/propylene copolymers, linear low density polyethylene (LLDPE) and mixtures thereof with low density polyethylene (LDPE), propylene/but-1-ene copolymers, propylene/isobutylene copolymers, ethylene/but-1-ene copolymers, ethylene/hexene copolymers, ethylene/methylpentene copolymers, ethylene/heptene copolymers, ethylene/octene copolymers, propylene/butadiene copolymers, isobutylene/isoprene copolymers, ethylene/alkyl acrylate copolymers, ethylene/alkyl methacrylate copolymers, ethylene/vinyl acetate copolymers and their copolymers with carbon monoxide or ethylene/acrylic acid copolymers and their salts (ionomers) as well as terpolymers of ethylene with propylene and a diene such as hexadiene, dicyclopentadiene or ethylidene-norbornene; and mixtures of such copolymers with one another and with polymers mentioned in 1) above, for example polypropylene/ethylene-propylene copolymers, LDPE/ethylene-vinyl acetate copolymers (EVA), LDPE/ethylene-acrylic acid copolymers (EAA), LLDPE/EVA, LLDPE/EAA and alternating or random polyalkylene/carbon monoxide copolymers and mixtures thereof with other polymers, for example polyamides.

The polyolefin may be a polypropylene homopolymer, a polypropylene copolymers, a polypropylene random copolymer, a polypropylene block copolymer, a polyethylene homopolymer, a polyethylene random copolymer, a polyethylene block copolymer, a low density polyethylene (LDPE), a linear low density polyethylene (LLDPE), a medium density polyethylene, a high density polyethylene (HDPE), or blends or mixtures of one or more of the preceding polymers.

The polyolefin may be a polypropylene. The term "polypropylene," as used herein, is intended to encompass any polymeric composition including propylene monomers, either alone or in mixture or copolymer with other randomly selected and oriented polyolefins, dienes, or other monomers (such as ethylene, butylene, and the like). Such a term also encompasses any different configuration and arrangement of the constituent monomers (such as atactic, syndiotactic, isotactic, and the like).

The polyolefin may be a polyethylene. The term "polyethylene," as used herein, is intended to encompass any polymeric composition including ethylene monomers, either alone or in mixture or copolymer with other randomly selected and oriented polyolefins, dienes, or other monomers (such as propylene, butylene, and the like). Such a term also encompasses any different configuration and arrangement of the constituent monomers (such as atactic, syndiotactic, isotactic, and the like).

Resins

As previously stated, the sole structures described herein include a plate including or consisting of a first resin, and one or more traction element including or consisting of a second resin. The first resin is a thermoplastic low surface energy and/or high hydrophobicity resin, and the second resin is a thermoplastic high surface energy and/or low hydrophobicity resin. In one aspect, the first resin is a thermoplastic polyolefin-based resin, and the second resin is a thermoplastic polyurethane-based resin. In a particular aspect, the first resin includes a polymeric component including or consisting of a thermoplastic polyolefin copolymer, a thermoplastic vulcanizate, and a polymeric resin modifier; and the second resin includes a polymeric component including or consisting of thermoplastic polyester-polyurethane elastomers. It has been found that a plate including a first resin as described herein, particularly a first resin including a polymeric component including or consisting of a thermoplastic polyolefin copolymer, a thermoplastic vulcanizate, and a polymeric resin modifier, has the durability and resistance to fracturing, chunking, and cracking suitable for use in the sole structures described herein. It has also been found that a traction element including a second resin as described herein, particularly a second resin including a polymeric component including or consisting of thermoplastic polyester-polyurethane elastomers, provides both durable ground-contacting surfaces, as well as surfaces of retention elements which form strong thermal and mechanical bonds with the first resin, including when the first resin is over-molded onto the retention feature of the traction element.

The first resins described herein may include one or more polyolefin. The one or more polyolefin may be a polyolefin homopolymer, a polyolefin copolymer, or both. The first resin may include a single type of a polyolefin homopolymer, or may include two or more of a variety of polyolefin homopolymers. The one or more polyolefin homopolymer can be selected from polyethylene, polypropylene, and combinations of polyethylene and polypropylene.

The first resin may include a single type of a polyolefin copolymer, or may include two or more of a variety of polyolefin copolymers. The copolymer or copolymers can be alternating copolymers or random copolymers or block copolymers or graft copolymers. In some aspects, the copolymers are random copolymers. In other aspects, the copolymer includes a plurality of repeat units, with each of the plurality of repeat units individually derived from an alkene monomer having about 1 to about 6 carbon atoms. In yet other aspects, the copolymer includes a plurality of repeat units, with each of the plurality of repeat units individually derived from a monomer selected from the group consisting of ethylene, propylene, 4-methyl-1-pentene, 1-butene, 1-octene, and a combination thereof. In some aspects, the polyolefin copolymer includes a plurality of repeat units each individually selected from Formula 1A-1D. In some other aspects, the polyolefin copolymer includes a first plurality of repeat units having a structure according to Formula 1A, and a second plurality of repeat units having a structure selected from Formula 1B-1D.

Formula 1A

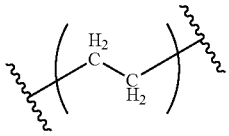

Formula 1B

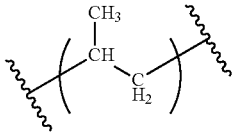

Formula 1C

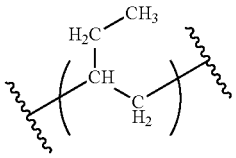

Formula 1D

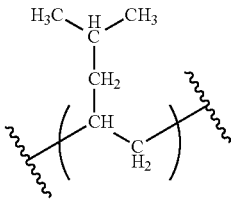

In some aspects, the polyolefin copolymer includes a plurality of repeat units each individually having a structure according to Formula 2

Formula 2

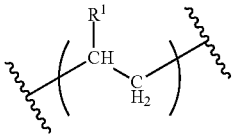

where $R^1$ is a hydrogen or a substituted or unsubstituted, linear or branched, $C_1$-$C_{12}$ alkyl. $C_1$-$C_6$ alkyl, $C_1$-$C_3$ alkyl, $C_1$-$C_{12}$ heteroalkyl, $C_1$-$C_6$ heteroalkyl, or $C_1$-$C_3$ heteroalkyl. In some aspects, each of the repeat units in the first plurality of repeat units has a structure according to Formula 1A above, and each of the repeat units in the second plurality of repeat units has a structure according to Formula 2 above.

In some aspects, the polyolefin copolymer is a random copolymer of a first plurality of repeat units and a second plurality of repeat units, and each repeat unit in the first plurality of repeat units is derived from ethylene and the each repeat unit in the second plurality of repeat units is derived from a second olefin. In some aspects, the second olefin is an alkene monomer having about 1 to about 6 carbon atoms. In other aspects, the second olefin includes propylene, 4-methyl-1-pentene, 1-butene, or other linear or branched terminal alkenes having about 3 to 12 carbon atoms. In some aspects, the polyolefin copolymer contains about 80 percent to about 99 percent, about 85 percent to about 99 percent, about 90 percent to about 99 percent, or about 95 percent to about 99 percent polyolefin repeat units by weight based upon a total weight of the polyolefin copolymer. In some aspects, the polyolefin copolymer consists of polyolefin repeat units. In some aspects, polymers in the first resin may consist of polyolefin polymers, meaning that all the polymers present in the first resin are polyolefin polymers (i.e., all the polymers are polyolefin homopolymers or polyolefin copolymers). Polymers in the first resin may consist of polyolefin copolymers, meaning that all the polymers present in the first resin are polyolefin copolymers.

The polyolefin copolymer can include ethylene, i.e. can include repeat units derived from ethylene such as those in Formula 1A. In some aspects, the polyolefin copolymer includes about 1 percent to about 5 percent, about 1 percent to about 3 percent, about 2 percent to about 3 percent, or about 2 percent to about 5 percent ethylene by weight based upon a total weight of the polyolefin copolymer.

The first resin can be made without polyurethanes and/or without polyamides and/or without polyesters, either in the form of separate polymers or polymer segments bonded to other types of polymeric segments (e.g., polyolefin segments). For example, in some aspects, the polyolefin copolymer is substantially free of polyurethane segments, or is substantially free of polyamide segments, or is substantially free of polyester segments, or is substantially free of any combination thereof. In some aspects, the polymer chains of the polyolefin copolymer are substantially free of urethane repeat units. The first resin may be substantially free of polymer chains including urethane repeat units. The polyolefin copolymer may be substantially free of polyamide. The polymer chains of the polyolefin copolymer may be substantially free of amide repeat units. The first resin may be substantially free of polymer chains including amide repeat units. The polyolefin copolymer may be substantially free of polyester. The polymer chains of the polyolefin copolymer may be substantially free of ester repeat units. The first resin may be substantially free of polymer chains including ester repeat units.

The polyolefin copolymer can include polypropylene or is a polypropylene copolymer. In some aspects, the polymeric component of the first resin (i.e., the portion of the first resin that includes all of the polymers present in the resin) consists of polypropylene copolymers. The polymeric component of the first resin can consist of a polypropylene copolymer, a thermoplastic vulcanizate (TPV), and optionally a polymeric resin modifier. Such first resins perform well under cold conditions, as demonstrated by passing a flex test pursuant to the Cold Ross Flex Test using the Plaque Sampling Procedure described herein, or when measured pursuant to ASTM D 5963-97a using the Material Sampling Procedure.

When the first resin includes a polypropylene copolymer, the polypropylene copolymer can include a random copolymer, e.g. a random copolymer of ethylene and propylene. The polypropylene copolymer can include about 80 percent to about 99 percent, about 85 percent to about 99 percent, about 90 percent to about 99 percent, or about 95 percent to about 99 percent propylene repeat units by weight based upon a total weight of the polypropylene copolymer. In some aspects, the polypropylene copolymer includes about 1 percent to about 5 percent, about 1 percent to about 3 percent, about 2 percent to about 3 percent, or about 2 percent to about 5 percent ethylene by weight based upon a total weight of the polypropylene copolymer. In some aspects, the polypropylene copolymer is a random copolymer including about 2 percent to about 3 percent of a first plurality of repeat units by weight and about 80 percent to about 99 percent by weight of a second plurality of repeat units based upon a total weight of the polypropylene copolymer; wherein each of the repeat units in the first plurality of repeat units has a structure according to Formula 1A above and each of the repeat units in the second plurality of repeat units has a structure according to Formula 1B above.

The first resin can include a polypropylene copolymer which is a random copolymer of propylene with about 2.2 percent by weight (wt. percent) ethylene is commercially available under the tradename "PP9054" from ExxonMobil Chemical Company, Houston, TX. It has a MFR (ASTM-1238D, 2.16 kilograms, 230 degrees Celsius.) of about 12 grams/10 minutes and a density of 0.90 grams/cubic centimeter (g/cm$^3$).

The first resin can include a polypropylene copolymer which is a random copolymer of propylene with about 2.8 percent by weight (wt. percent) ethylene and is commercially available under the tradename "PP9074" from ExxonMobil Chemical Company, Houston, TX. It has a MFR (ASTM-1238D, 2.16 kilograms, 230 degrees Celsius.) of about 24 grams/10 minutes and a density of 0.90 grams/cubic centimeter (g/cm$^3$).

When the first resin includes the optional polymeric resin modifier, the polymeric resin modifier can provide improved flexural strength, toughness, creep resistance, or flexural durability without a significant loss in the abrasion resistance. The first resin can include the polymeric resin modifier in an amount of about 5 percent to about 30 percent, about 5 percent to about 25 percent, about 5 percent to about 20 percent, about 5 percent to about 15 percent, about 5 percent to about 10 percent, about 10 percent to about 15 percent, about 10 percent to about 20 percent, about 10 percent to about 25 percent, or about 10 percent to about 30 percent by weight based upon a total weight of the first resin. In some aspects, the concentration of the polymeric resin modifier is about 20 percent, about 15 percent, about 10 percent, about 5 percent, or less by weight based upon a total weight of the first resin.

The polyolefin copolymer or the optional polymeric resin modifier can include a variety of exemplary resin modifiers described herein. The polymeric resin modifier may be a metallocene catalyzed copolymer primarily composed of isotactic propylene repeat units with about 11 percent by weight to about 15 percent by weight of ethylene repeat units based on a total weight of metallocene catalyzed copolymer randomly distributed along the copolymer. The polymeric resin modifier may include about 10 percent to about 15 percent ethylene repeat units by weight based upon a total weight of the polymeric resin modifier. The polymeric resin modifier may include about 10 percent to about 15 percent repeat units according to Formula 1A above by weight based upon a total weight of the polymeric resin modifier. The polymeric resin modifier may be a copolymer of repeat units according to Formula 1B above, and the repeat units according to Formula 1B are arranged in an isotactic stereochemical configuration.

The polyolefin copolymer or the optional polymeric resin modifier may be a copolymer containing isotactic propylene repeat units and ethylene repeat units. The polymeric resin modifier may be a copolymer including a first plurality of repeat units and a second plurality of repeat units; wherein each of the repeat units in the first plurality of repeat units has a structure according to Formula 1A above and each of the repeat units in the second plurality of repeat units has a structure according to Formula 1B above, and wherein the repeat units in the second plurality of repeat units are arranged in an isotactic stereochemical configuration.

The polyolefin copolymer or the optional polymeric resin modifier may be a copolymer primarily composed of isotactic propylene repeat units with about 15 percent by weight (wt. percent) of ethylene repeat units randomly distributed along the copolymer. It is a metallocene catalyzed copolymer available under the tradename "VISTAMAXX 6202" from ExxonMobil Chemical Company, Houston, TX and has an MFR (ASTM-1238D, 2.16 kilograms, 230 degrees Celsius.) of about 20 grams/10 minutes, a density of 0.862 grams/cubic centimeter (g/cm$^3$), and a Durometer Hardness of about 64 (Shore A).

The polyolefin copolymer or the optional polymeric resin modifier may be a copolymer primarily composed of isotactic propylene repeat units with about 11 percent by weight (wt. percent) of ethylene repeat units randomly distributed along the copolymer. It is a metallocene catalyzed copolymer available from ExxonMobil Chemical Company and has an MFR (ASTM-1238D, 2.16 kilograms, 230 degrees Celsius.) of about 8 grams/10 minutes, a density of 0.873 grams/cubic centimeter (g/cm$^3$), and a Durometer Hardness of about 27 (Shore D).

The polyolefin copolymer or the optional polymeric resin modifier may be a copolymer primarily composed of isotactic propylene repeat units with about 13 percent by weight of ethylene repeat units randomly distributed along the copolymer. It is a metallocene catalyzed copolymer available from ExxonMobil Chemical Company and has an MFR (ASTM-1238D, 2.16 kilograms, 230 degrees Celsius.) of about 45 grams/10 minutes, a density of 0.865 grams/cubic centimeter (g/cm$^3$), and a Durometer Hardness of about 71 (Shore A).

The one or more polyolefin of the first resin may include a thermoplastic vulcanizate (TPV). A TPV includes an at least partially crosslinked (e.g., vulcanized), elastomer (e.g., rubber) phase dispersed within a thermoplastic phase. In the TPV, the elastomer phase may include finely dispersed crosslinked elastomer particles in a continuous thermoplastic phase. An advantage of TPVs is that they can have properties of the two main components, elastomer (e.g., rubber) and the thermoplastic. In particular, TPVs can have elastomeric properties provided by the elastomer phase and processability provided by the thermoplastic phase, which make it possible to use processes which soften or melt the thermoplastic phase of the TPV, such as thermoforming, extrusion, and injection molding. In general, the TPV includes a crosslinked elastomer (e.g., a cured rubber, particularly a cured polyolefin rubber) dispersed in a thermoplastic phase (e.g., a thermoplastic phase including one or more thermoplastic polyolefins). The TPV may be free or substantially free of one or more of: hygroscopic fillers, fillers, and pigments, or the TPV may include one or more of hygroscopic fillers, fillers, and pigments.

When the thermoplastic phase of the TPV includes a thermoplastic polyolefin, the type of polyolefin homopolymers or copolymers present in the thermoplastic polyolefin phase of the TPV (e.g., ethylene polymers, ethylene copolymers, propylene polymers, propylene copolymers) may include at least one of the same type of polyolefin homopolymers or copolymers present in the first resin, e.g., the same polyolefin copolymer, or the same polyolefin homopolymer or copolymer present in the polymeric resin modifier. For example, the thermoplastic polyolefin phase of the TPV and the first resin may each separately include one or more propylene homopolymers or copolymers. The shared polyolefin homopolymers or copolymers of the same type may include monomeric units having the same chemical structures. For example, the thermoplastic polyolefin phase of the TPV and the first resin may each separately include propylene homopolymers, or may each separately include polypropylene, or may each separately include 1-butene copolymers.

Alternatively, when the thermoplastic phase of the TPV includes a thermoplastic polyolefin, the type of polyolefin homopolymers or copolymers present in the thermoplastic polyolefin resin phase of the TPV (e.g., ethylene polymers, ethylene copolymers, propylene polymers, propylene copolymers) may differ from the types of polyolefin homopolymers or copolymers present in the first resin of the plate. For example, the thermoplastic polyolefin resin phase of the TPV may include one or more propylene homopolymers or copolymers, while the first resin is substantially free of propylene homopolymers or copolymers (except for those present in the TPV). The thermoplastic polyolefin resin phase of the TPV may include a propylene homopolymer, while the first resin of the plate (other than the TPV) includes a propylene copolymer, including a propylene-ethylene copolymer.

The TPV may have a specific gravity of about 0.8 grams per cubic centimeter to about 1.2 grams per cubic centimeter, about 0.8 grams per cubic centimeter to about 1.0 grams per cubic centimeter, about 0.9 grams per cubic centimeter to about 1.0 grams per cubic centimeter, or about 0.9 grams per cubic centimeter to about 1.0 grams per cubic centimeter as determined by ASTM D792.

The TPV may have a Shore D Hardness (15 seconds at 23 degrees Celsius) of about 40 to about 60, about 40 to about 55, about 45 to about 60, about 45 to about 55, or about 50 to about 55 as determined by ISO 868.

The TPV may have an elongation at yield at 23 degrees Celsius of about 20 percent to about 40 percent, about 20 percent to about 35 percent, about 25 percent to about 40 percent, or about 25 percent to about 35 percent as determined by ASTM D638.

The TPV may include or consist of an EPDM rubber in a thermoplastic phase of polypropylene (PP). Depending on the ratio of EPDM rubber to PP, the physical properties such as hardness, modulus and flexibility can vary. In one aspect, the TPV is a SANTOPRENE TPV manufactured by ExxonMobil. In another aspect, the TPV is SANTOPRENE 203-50 manufactured by ExxonMobil.

The TPV may include about 5 percent to about 30 percent, about 10 percent to about 30 percent, about 15 percent to about 30 percent, or about 15 percent to about 25 percent of the first resin by weight based upon a total weight of the first resin.

The first resin may further include a clarifying agent. The clarifying agent can allow for clear visibility of a textile through the plate. The clarifying agent can be present in any suitable amount to provide sufficient optical clarity of the final plate or sole structure. In some aspects, the clarifying agent is present in an amount from about 0.5 percent by weight to about 5 percent by weight or about 1.5 percent by weight to about 2.5 percent by weight based upon a total weight of the first resin. The clarifying agent can include those selected from the group of substituted or unsubstituted dibenzylidene sorbitol, 1,3-O-2,4-bis(3,4-dimethylbenzylidene) sorbitol, 1,2,3-trideoxy-4,6:5,7-bis-O-[(4-propylphenyl)methylene], and a derivative thereof. The clarifying agent can include an acetal compound that is the condensation product of a polyhydric alcohol and an aromatic aldehyde. The polyhydric alcohol can include those selected from the group consisting of acyclic polyols such as xylitol and sorbitol and acyclic deoxy polyols such as 1,2,3-trideoxynonitol or 1,2,3-trideoxynon-1-enitol. The aromatic aldehyde can include those selected from the group consisting of benzaldehyde and substituted benzaldehydes.

The clarifying agent may be present in an amount from about 0.5 percent by weight to about 5 percent by weight or about 1.5 percent by weight to about 2.5 percent by weight based upon a total weight of the polyolefin-based resin.

The first resin may have a Notched Izod Strength of about 400 Joules per meter to about 800 Joules per meter, about 500 Joules per meter to about 800 Joules per meter, about 550 Joules per meter to about 800 Joules per meter, about 550 Joules per meter to about 750 Joules per meter, or about 550 Joules per meter to about 700 Joules per meter as determined by ASTM D246 at 23 degrees Celsius.

The first resin may have a Flex Modulus 1 percent Secant of about 400 millipascals to about 800 millipascals, about 500 millipascals to about 800 millipascals, about 550 millipascals to about 800 millipascals, about 550 millipascals to about 750 millipascals, or about 550 millipascals to about 700 millipascals as determined by ASTM D790.

The first resin may have a melt flow index of about 10 grams per 10 minutes to about 30 grams per 10 minutes, about 15 grams per 10 minutes to about 30 grams per 10 minutes, about 20 grams per 10 minutes to about 30 grams per 10 minutes, or about 15 grams per 10 minutes to about 25 grams per 10 minutes as determined by ASTM D1238 at 230 degrees Celsius using a 2.16 kilogram weight.

Turning now to the second resin of the one or more traction element, the second resin includes one or more thermoplastic polymers having a high surface energy and/or a low hydrophobicity. The one or more thermoplastic polymer of the second resin may be a polymer having repeating polymeric units of the same chemical structure (segments) which are relatively harder (hard segments), and repeating polymeric segments which are relatively softer (soft segments). The hard segments can include isocyanate segments, and the soft segments can include an alkoxy group such as polyether segments and polyester segments. The alkoxy segment may include an alkoxy polyamide segment and the like.

The one or more thermoplastic polymer of the second resin may be a thermoplastic polyurethane (also referred to as "TPU"). The thermoplastic polyurethane may be a thermoplastic polyurethane elastomer. The thermoplastic polyurethane may include hard and soft segments. The hard segments may include or consist of isocyanate segments (e.g., diisocyanate segments), and the soft segments may include or consist of alkoxy segments (e.g., polyether segments, or polyester segments, or a combination of polyether segments and polyester segments). Thus, the polyurethane may be a polyester-polyurethane copolymer, or a polyether-polyurethane copolymer, or a polyether-polyester-polyurethane copolymer. The thermoplastic polyurethane may include or consist of an thermoplastic polyurethane elastomer having repeating hard segments and repeating soft segments.

The second resin may include one or more thermoplastic polyamides. The polyamide may include a thermoplastic polyamide elastomer. The polyamide can be a polyamide homopolymer having repeating polyamide segments of the same chemical structure. Alternatively, the polyamide can include a number of polyamide segments having different polyamide chemical structures (e.g., polyamide 6 segments, polyamide 11 segments, polyamide 12 segments, polyamide 66 segments, etc.). The polyamide segments having different chemical structures can be arranged randomly, or can be arranged as repeating blocks. The polyamide may be a block co-polyamide, such as a polyether block amide (PEBA) copolymer.

The second resin may include a thermoplastic polyester, including a thermoplastic polyester elastomer The polyester may be a polybutylene terephthalate (PBT), a polytrimethylene terephthalate, a polyhexamethylene terephthalate, a poly-1,4-dimethylcyclohexane terephthalate, a polyethylene terephthalate (PET), a polyethylene isophthalate (PEI), a polyarylate (PAR), a polybutylene naphthalate (PBN), a liquid crystal polyester, or a blend or mixture of two or more of the foregoing. The polyester may be a co-polyester (i.e., a co-polymer including polyester segments and non-polyester segments). The co-polyester can be an aliphatic co-polyester (i.e., a co-polyester in which both the polyester segments and the non-polyester segments are aliphatic). Alternatively, the co-polyester may include aromatic segments. The polyester segments of the co-polyester can include or consist of polyglycolic acid segments, polylactic acid segments, polycaprolactone segments, polyhydroxyalkanoate segments, polyhydroxybutyrate segments, or any combination thereof. The polyester segments of the co-polyester can be arranged randomly, or can be arranged as repeating blocks.

Making Resins

The resins described herein can be made by blending the polymeric and non-polymeric ingredients to form a blended composition. Methods of blending polymers can include film blending in a press, blending in a mixer (e.g. mixers commercially available under the tradename "HAAKE" from Thermo Fisher Scientific, Waltham, MA), solution blending, hot melt blending, and extruder blending. In some aspects, the polymeric ingredients (e.g., the polymeric resin modifier, polyolefin copolymer, and the TPV) are miscible such that they can be readily mixed by the screw in the injection barrel during injection molding, e.g. without the need for a separate blending step.

Methods of Manufacturing Sole Structures

The methods of manufacturing the sole structures described herein include extruding or injecting the first resin (e.g., a blended first resin) onto one or more traction elements.

Extruding the first resin can include conveying a softened first resin through a die with an opening and into a mold cavity. The first resin can be conveyed forward by a feeding screw and forced through the barrel and the die and into a mold cavity. Heating elements, placed over the barrel, can soften and melt the first resin. The temperature of the first resin can be controlled by thermocouples.

Injection molding the first resin includes forcing the resin through a heated cylinder wherein the resin is heated by heat conducted from the walls of the cylinder to the resin. This may include the use of a non-rotating, cold plunger to force the solid resin into the cylinder. The injection molding may include the use of a rotating screw (e.g., a single-screw or twin screws), disposed co-axially of a heated barrel, for conveying the pelletized resin toward a first end of the screw and to heat the resin by the conduction of heat from the heated barrel to the resin. As the resin is conveyed by the screw mechanism toward the first end, the screw is translated toward the second end so as to produce a reservoir space at the first end. When sufficient melted resin is collected in the reservoir space, the screw mechanism can be pushed toward the first end so as to inject the material into a mold cavity containing the one or more traction element. Following the extruding or injecting, the extruded or injected first resin is solidified in the mold cavity while in contact with the one or more traction element, thereby molding a plate and embedding at least a retention feature of the one or more traction element into the first resin of the plate, and forming thermal bonds between the first resin of the plate and the second resin of the retention feature. After the sole structure including the molded plate and overmolded traction elements has solidified, it is removed from the mold cavity.

Methods of Manufacturing Articles of Footwear

The present disclosure is also directed to manufacturing articles of footwear including the sole structures described herein. The method includes affixing the sole structure to an upper for an article of footwear, thereby forming an article of footwear. The step of affixing the sole structure to the upper can include applying a polymeric adhesive to a surface of the upper, to a surface of the sole structure, or to both a surface of the upper and a surface of the sole structure, placing the surface of the upper in contact with the surface of the sole structure, and applying pressure and/or heat until an adhesive bond is achieved. Alternatively, the method may including placing the upper in a mold cavity, and extruding or injecting molten or softened resin onto a surface of the upper, and solidifying the resin, forming a thermal bond between the upper and the sole structure; and, following the solidifying, removing the article of footwear from the mold cavity. In one aspect, the resin is the first resin, and the method further includes extruding or injecting the first resin onto one or more traction element, forming a plate portion of the sole structure, embedding the one or more traction element into the plate, and forming a thermal bond between the first resin and a second resin defining a surface of at least a retention feature of the one or more traction element.

Property Analysis and Characterization Procedures

Cold Ross Flex Test

The cold Ross flex test is determined according to the following test method. The purpose of this test is to evaluate the resistance to cracking of a sample under repeated flexing to 60 degrees in a cold environment. A thermoformed plaque of the material for testing is sized to fit inside the flex tester machine. Each material is tested as five separate samples. The flex tester machine is capable of flexing samples to 60 degrees at a rate of 100±5 cycles per minute. The mandrel diameter of the machine is 10 millimeters. Suitable machines for this test are the Emerson AR-6, the Satra STM 141F, the Gotech GT-7006, and the Shin II Scientific SI-LTCO (DaeSung Scientific). The sample(s) are inserted into the machine according to the specific parameters of the flex machine used. The machine is placed in a freezer set to −6 degrees Celsius for the test. The motor is turned on to begin flexing with the flexing cycles counted until the sample cracks. Cracking of the sample means that the surface of the material is physically split. Visible creases of lines that do not actually penetrate the surface are not cracks. The sample is measured to a point where it has cracked but not yet broken in two.

Contact Angle Test

This test measures the contact angle of the layered material based on a static sessile drop contact angle measurement for a sample (e.g., taken with the above-discussed Footwear Sampling Procedure or Co-extruded Film Sampling Procedure). The contact angle refers to the angle at which a liquid interface meets a solid surface, and is an indicator of how hydrophilic the surface is.

For a dry test (i.e., to determine a dry-state contact angle), the sample is initially equilibrated at 25 degrees Celsius and 20 percent humidity for 24 hours.

The dry sample is then placed on a moveable stage of a contact angle goniometer commercially available under the tradename "RAME-HART F290" from Rame-Hart Instrument Co., Succasunna, N.J. A 10-microliter droplet of deionized water is then placed on the sample using a syringe and automated pump. An image is then immediately taken of the droplet (before film can take up the droplet), and the contact angle of both edges of the water droplet are measured from the image.

Sampling Procedures

Various properties of the resins (e.g., first and second resins), including sole structures, plates and other articles formed therefrom can be characterized using samples prepared with the following sampling procedures:

Material Sampling Procedure

A material sampling procedure can be used to obtain a neat sample of a resin or, in some instances, a sample of a material used to form a resin. The material is provided in media form, such as flakes, granules, powders, pellets, and the like. If a source of the resin is not available in a neat form, the sample can be cut from a plate or other component containing the resin, thereby isolating a sample of the material.

Plaque Sampling Procedure

The polymeric and non-polymeric ingredients of a resin such as a first resin or a second resin are combined to form the resin. A portion of the resin is then molded into an appropriately-sized plaque, such as a plaque sized to fit inside the Ross flexing tester used, the plaque having dimensions of about 15 centimeters (cm) by 2.5 centimeters (cm) and a thickness of about 1 millimeter (mm) to about 4 millimeter (mm), by thermoforming the resin in a mold. The sample is prepared by mixing the components of the resin together, melting the components, pouring, extruding, or injecting the molten resin into the mold cavity, cooling the molten resin to solidify it in the mold cavity to form the plaque, and then removing the solid plaque from the mold cavity.

Definitions

Unless defined otherwise, all technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the specification and relevant art and should not be interpreted in an idealized or overly formal sense unless expressly defined herein.

Although any methods and materials similar or equivalent to those described herein can also be used in the practice or testing of the present disclosure, the preferred methods and materials are now described. Functions or constructions well-known in the art may not be described in detail for brevity and/or clarity. Aspects of the present disclosure will employ, unless otherwise indicated, techniques of nanotechnology, organic chemistry, material science and engineering and the like, which are within the skill of the art. Such techniques are explained fully in the literature.

It should be noted that ratios, concentrations, amounts, and other numerical data can be expressed herein in a range format. Where the stated range includes one or both of the limits, ranges excluding either or both of those included limits are also included in the disclosure, e.g. the phrase "x to y" includes the range from 'x' to 'y' as well as the range greater than 'x' and less than 'y.' The range can also be expressed as an upper limit, e.g. 'about x, y, z, or less' and should be interpreted to include the specific ranges of 'about x,' 'about y,' and 'about z' as well as the ranges of 'less than x,' less than y,' and 'less than z.' Likewise, the phrase 'about x, y, z, or greater' should be interpreted to include the specific ranges of 'about x,' 'about y,' and 'about z' as well as the ranges of 'greater than x,' greater than y,' and 'greater than z.' In addition, the phrase "about 'x' to 'y'", where 'x' and 'y' are numerical values, includes "about 'x' to about 'y'". It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1 percent to 5 percent" should be interpreted to include not only the explicitly recited values of about 0.1 percent to about 5 percent, but also include individual values (e.g., 1 percent, 2 percent, 3 percent, and 4 percent) and the sub-ranges (e.g., 0.5 percent, 1.1 percent, 2.4 percent, 3.2 percent, and 4.4 percent) within the indicated range.

The term "about," as used herein, can include traditional rounding according to significant figures of the numerical value. In some aspects, the term about is used herein to mean a deviation of 10 percent, 5 percent, 2.5 percent, 1 percent, 0.5 percent, 0.1 percent, 0.01 percent, or less from the specified value.

The articles "a" and "an," as used herein, mean one or more when applied to any feature in aspects of the present disclosure described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

The term "isotactic," as used herein, with respect to polypropylene homopolymer or copolymer, is defined as at least three methyl groups (a triad) aligned in the same direction. In one aspect, the polypropylene homopolymer or copolymer has at least about 10 percent isotactic triads, at least about 20 percent isotactic triads, at least about 30 percent isotactic triads, at least about 40 percent isotactic triads, at least about 50 percent isotactic triads, at least about 60 percent isotactic triads, at least about 70 percent isotactic triads, or at least about 80 percent isotactic triads as determined by $^{13}C$ NMR spectroscopy.

A random copolymer of propylene with about 2.2 percent by weight (wt percent) ethylene is commercially available under the tradename "PP9054" from ExxonMobil Chemical Company, Houston, TX. It has a MFR (ASTM-1238D, 2.16 kilograms, 230 degrees Celsius.) of about 12 grams/10 minutes and a density of 0.90 grams/cubic centimeter (g/cm$^3$).

PP9074 is a random copolymer of propylene with about 2.8 percent by weight (wt percent) ethylene and is commercially available under the tradename "PP9074" from ExxonMobil Chemical Company, Houston, TX. It has a MFR (ASTM-1238D, 2.16 kilograms, 230 degrees Celsius.) of about 24 grams/10 minutes and a density of 0.90 grams/cubic centimeter (g/cm$^3$).

PP1,024E4 is a propylene homopolymer commercially available under the tradename "PP1,024E4" from ExxonMobil Chemical Company, Houston, TX. It has an MFR (ASTM-1238D, 2.16 kilograms, 230 degrees Celsius.) of about 13 grams/10 minutes and a density of 0.90 grams/cubic centimeter (g/cm$^3$).

VISTAMAXX 6202 is a copolymer primarily composed of isotactic propylene repeat units with about 15 percent by weight (wt. percent) of ethylene repeat units randomly distributed along the copolymer. It is a metallocene catalyzed copolymer available under the tradename "VISTAMAXX 6202" from ExxonMobil Chemical Company, Houston, TX and has an MFR (ASTM-1238D, 2.16 kilograms, 230 degrees Celsius.) of about 20 grams/10 minutes, a density of 0.862 grams/cubic centimeter (g/cm$^3$), and a Durometer Hardness of about 64 (Shore A).

VISTAMAXX 3000 is a copolymer primarily composed of isotactic propylene repeat units with about 11 percent by weight (wt. percent) of ethylene repeat units randomly distributed along the copolymer. It is a metallocene catalyzed copolymer available from ExxonMobil Chemical Company and has an MFR (ASTM-1238D, 2.16 kilograms, 230 degrees Celsius) of about 8 grams/10 minutes, a density of 0.873 grams/cubic centimeter (g/cm$^3$), and a Durometer Hardness of about 27 (Shore D).

VISTAMAXX 6502 is a copolymer primarily composed of isotactic propylene repeat units with about 13 percent by weight of ethylene repeat units randomly distributed along the copolymer. It is a metallocene catalyzed copolymer available from ExxonMobil Chemical Company and has an MFR (ASTM-1238D, 2.16 kilograms, 230 degrees Celsius) of about 45 grams/10 minutes, a density of 0.865 grams/cubic centimeter (g/cm$^3$), and a Durometer Hardness of about 71 (Shore A).

We claim:

1. A sole structure for an article of footwear, the sole structure comprising:

a plate having a first side configured to be ground-facing and a second side formed on an opposite side of the plate than the first side, the plate comprising a polyolefin-based first resin; and a traction element extending from the first side of the plate and including a stud tip, a stud shaft extending from the stud tip and including a frustoconical shape having a proximal end disposed at a junction of the stud shaft and the stud tip that defines a smallest cross-sectional area of the stud shaft, a plurality of first retention features extending from an outer surface of the stud shaft, a plurality of second retention features extending from the outer surface of the stud shaft, and a first planar surface extending between and separating first retention features of the plurality of first retention features from second retention features of the plurality of second retention features, the traction element comprising a polyurethane-based second resin.

2. The sole structure of claim 1, wherein the traction element is embedded in the first resin of the plate.

3. The sole structure of claim 1, wherein the second resin of the plurality of first retention features is thermally bonded to the first resin of the plate.

4. The sole structure of claim 1, wherein first retention features of the plurality of first retention features and second retention features of the plurality of second retention features define a series of alternating peaks and valleys that extend from the junction of the proximal end of the stud shaft and the stud tip to a distal end of the stud shaft.

5. The sole structure of claim 1, further comprising a second planar surface disposed between the first planar surface and one of the plurality of first retention features and the plurality of second retention features.

6. The sole structure of claim 5, wherein the first planar surface converges with the second planar surface.

7. The sole structure of claim 5, further comprising a third planar surface and a fourth planar surface extending between the plurality of first retention features and the plurality of second retention features on an opposite side of the stud shaft than the first planar surface and the second planar surface.

8. The sole structure of claim 7, wherein the first planar surface, the second planar surface, the third planar surface, and the fourth planar surface extend from the junction of the proximal end of the stud shaft and the stud tip to a distal end of the stud shaft.

9. The sole structure of claim 1, wherein the plurality of first retention features extend continuously along an entire length of the stud shaft from the junction of the proximal end of the stud shaft and the stud tip to a distal end of the stud shaft.

10. The sole structure of claim 9, wherein the plurality of second retention features extend continuously along an entire length of the stud shaft from the junction of the proximal end of the stud shaft and the stud tip to a distal end of the stud shaft.

11. A sole structure for an article of footwear, the sole structure comprising:

a plate having a first side configured to be ground-facing and a second side formed on an opposite side of the plate than the first side, the plate comprising a polyolefin-based first resin; and a traction element extending from the first side of the plate and including a stud tip, a stud shaft extending from the stud tip and including a proximal end that is coupled to the stud tip and has a diameter that is less than a distal end of the stud shaft, a plurality of first retention features extending from an outer surface of the stud shaft, a plurality of second retention features extending from the outer surface of the stud shaft, and a first planar surface extending between and separating first retention features of the plurality of first retention features from second retention features of the plurality of second retention features, the traction element comprising a polyurethane-based second resin.

12. The sole structure of claim 11, wherein the traction element is embedded in the first resin of the plate.

13. The sole structure of claim 11, wherein the second resin of the plurality of first retention features is thermally bonded to the first resin of the plate.

14. The sole structure of claim 11, wherein first retention features of the plurality of first retention features and second retention features of the plurality of second retention features define a series of alternating peaks and valleys that extend from a junction of the proximal end of the stud shaft and the stud tip to the distal end of the stud shaft.

15. The sole structure of claim 11, further comprising a second planar surface disposed between the first planar surface and one of the plurality of first retention features and the plurality of second retention features.

16. The sole structure of claim 15, wherein the first planar surface converges with the second planar surface.

17. The sole structure of claim 15, further comprising a third planar surface and a fourth planar surface extending between the plurality of first retention features and the plurality of second retention features on an opposite side of the stud shaft than the first planar surface and the second planar surface.

18. The sole structure of claim 17, wherein the first planar surface, the second planar surface, the third planar surface, and the fourth planar surface extend from a junction of the proximal end of the stud shaft and the stud tip to the distal end of the stud shaft.

19. The sole structure of claim 11, wherein the stud shaft includes a frustoconical shape.

20. The sole structure of claim 11, wherein the distal end of the stud shaft is substantially planar.

* * * * *